US008385800B2

(12) United States Patent
Masuda et al.

(10) Patent No.: US 8,385,800 B2
(45) Date of Patent: Feb. 26, 2013

(54) FIXING DEVICE FOR IMAGE FORMING DEVICE, CAPABLE OF ADJUSTING NIP FORCE BETWEEN HEATING ROLLER AND PRESSURE ROLLER

(75) Inventors: Takehiro Masuda, Nagoya (JP); Takuji Matsuno, Ichinomiya (JP); Masaki Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 796 days.

(21) Appl. No.: 11/844,641

(22) Filed: Aug. 24, 2007

(65) Prior Publication Data

US 2008/0310895 A1 Dec. 18, 2008

(30) Foreign Application Priority Data

Aug. 25, 2006 (JP) ..... P2006-229814
Jan. 19, 2007 (JP) ..... P2007-009830

(51) Int. Cl.
*G03G 15/20* (2006.01)

(52) U.S. Cl. ..... 399/328; 399/110; 399/320

(58) Field of Classification Search ..... 399/328
See application file for complete search history.

(56) References Cited

U.S. PATENT DOCUMENTS 6,526,239 B2 * 2/2003 Shiiya ..... 399/67
7,113,716 B2 9/2006 Tomatsu
7,440,723 B2 10/2008 Uehara et al.
2003/0118382 A1 * 6/2003 Tomatsu ..... 399/328
2005/0214043 A1 * 9/2005 Kameda ..... 399/328
2006/0147226 A1 * 7/2006 Sato et al. ..... 399/122
2006/0239715 A1 * 10/2006 Lee et al. ..... 399/122
2008/0069589 A1 * 3/2008 Chang et al. ..... 399/122

FOREIGN PATENT DOCUMENTS

JP 05-084967 U 11/1993
JP 08-234601 A2 9/1996
JP 2002-287559 A 10/2002
JP 2004-279702 A 10/2004

OTHER PUBLICATIONS

English Translation of JP05-084967U, from http:www4.ipdl.inpit.go.jp/cgi-bin/tran_web_cgi_ejje.

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

A fixing device includes a frame, a pressure arm pivotably supported on the frame, and a nip release lever supported on the pressure arm. The pressure arm can release pressure contact between a heating roller and a pressure roller. The nip release lever can move between a pressing position and a release position so as to move the pressure roller between a position at which the pressure roller applies pressure to the heating roller and a position at which the pressure roller applies no pressure. The nip release lever can be halted in the release position.

20 Claims, 15 Drawing Sheets

FIXING DEVICE FOR IMAGE FORMING DEVICE, CAPABLE OF ADJUSTING NIP FORCE BETWEEN HEATING ROLLER AND PRESSURE ROLLER

CROSS REFERENCE TO RELATED APPLICATIONS

This application claims priority from Japanese Patent Application Nos. 2006-229814 and 2007-009830 filed Aug. 25, 2006 and Jan. 19, 2007, respectively. The entire content of each of these priority applications is incorporated herein by reference

TECHNICAL FIELD

The invention relates to a fixing device and an image forming device including the fixing device.

BACKGROUND

Generally, image-forming devices such as laser printers and digital photocopiers scan a laser beam over a photosensitive member based on data for an image to be printed, forming an electrostatic latent image on the photosensitive member. Subsequently, the image-forming device supplies toner for developing the electrostatic latent image, thereby forming a toner image, transfers the toner image onto paper, and fixes the toner image to the paper with heat.

In the heat fixing process, normally the paper is interposed between a heating roller provided with a heater, and a pressure roller that rotates together with the heating roller. The heating roller heats the paper, while the pressure roller presses the developed image into the paper.

However, there are so many different. Types of paper used in printing, such as very thin paper with little stiffness and envelopes configured of two sheets of paper conveyed simultaneously. If the heating roller and the pressure roller do not grip the paper with an appropriate force, conveying problems can occur. For example, the paper may be wrinkled.

Conventional image-forming devices, such as that disclosed in U.S. Pat. No. 7,113,716, are provided with a mechanism for adjusting the force at which the heating roller and the pressure roller grip the paper. However, the mechanism for adjusting the nip force in U.S. Pat. No. 7,113,716 is complex.

If the paper is wrinkled, for example, during the fixing process, paper jams may occur frequently between the heating roller and the pressure roller. Although the paper jam can be resolved by pulling out the jammed paper, such removal is not easy when the paper is firmly gripped between the heating roller and the pressure roller. Therefore, a fixing device disclosed in Japanese unexamined patent application publication No. HEI-5-84967 has a mechanism for temporarily releasing the pressure contact (hereinafter referred to as the "nip") between the heating roller and the pressure roller to facilitate removal of the jammed paper.

However, in the fixing device disclosed in Japanese unexamined patent application publication No. HEI-5-84967, the user presses down on a pressure arm to release the nip on the paper and must continue to hold the pressure arm down while pulling out the jammed paper.

A fixing device disclosed in Japanese unexamined patent application publication No. HEI-8-234601, on the other hand, can maintain the nip release state without requiring the user to hold down the pressure arm. However, a lever part for releasing the nip is positionally and mechanically separated from the fixing device, resulting not only in a complex structure, but also an inefficient use of space.

SUMMARY

In view of the foregoing, it is an object of the invention to provide a compact fixing device having a simple structure and capable of adjusting the nip force, and an image-forming device provided with the fixing device.

In order to attain the above and other objects, the invention provides a fixing device including a heating roller, a pressure roller that fixes a developer image formed on a recording medium onto the recording medium through cooperative operation with the heating roller, a frame that rotatably supports the heating holler, a pressure arm that is pivotably supported on the frame and that rotatably supports the pressure roller and a pressure releasing member disposed on the pressure arm. The pressure releasing member is capable of moving between a pressing position and a release position so as to move the pressure roller between a first position at which the pressure roller is in pressing contact with the heating roller and a second position at which the pressure roller is separated from the heating roller. The pressure releasing member is capable of being halted in the release position.

There is also provided with an image forming device including an image forming unit that forms a developer image on a recording medium and a fixing device that fixes the developer image onto the recording medium. The fixing device includes a heating roller, a pressure roller that fixes the developer image onto the recording medium through cooperative operation with the heating roller, a frame that rotatably supports the heating holler, a pressure arm that is pivotably supported-on the frame and that rotatably supports the pressure roller, and a pressure releasing member disposed on the pressure arm. The pressure releasing member is capable of moving between a pressing position and a release position so as to move the pressure roller between a first position at which the pressure roller is in pressing contact with the heating roller and a second position at which the pressure roller is separated from the heating roller, the pressure releasing member being capable of being halted in the release position.

There is also provided a fixing device including a heating roller, a pressure roller that fixes a developer image formed on a recording medium onto the recording medium through cooperative operation with the heating roller, a frame that, rotatably supports the heating holler, a pressure arm that is pivotably supported on the frame and that rotatably supports the pressure roller, a spring that is engaged in the pressure arm and that urges, through the pressure arm, the pressure roller to contact the heating roller with pressure, and a pressing force adjusting member that is pivotably supported on the pressure arm at a position separated from a pivoting center of the pressure arm. The pressing force adjusting member includes an operating part that is operated by a user and a weak pressure release arm having a distal end that is capable of contacting and engaging with the frame to move the pressure arm against the urging force of the spring, thereby producing a weak pressing state in which the urging force applied to the pressure roller by the spring is decreased.

Further, there is provided an image forming device including an image forming unit that forms a developer image onto a recording medium and a fixing device that fixes the developer image onto the recording medium. The fixing device includes a heating roller, a pressure roller that fixes the developer image onto the recording medium through cooperative operation with the heating roller, a frame that rotatably supports the heating holler, a pressure arm that is pivotably supported on the frame and that rotatably supports the pressure roller, a spring that is engaged in the pressure arm and that urges, through the pressure arm, the pressure roller to contact the heating roller with pressure, and a pressing force adjusting member that is pivotably supported on the pressure arm at a position separated from a pivoting center of the pressure arm. The pressing force adjusting member includes an operating part that is operated by a user and a weak pressure release arm having a distal end that is capable of contacting and engaging with the frame to move the pressure arm against the urging force of the spring, thereby producing a weak pressing state in which the urging force applied to the pressure roller by the spring is decreased.

BRIEF DESCRIPTION OF THE DRAWINGS

Illustrative embodiments in accordance with the invention will be described in detail with reference to the following figures wherein:

FIG. 6(*b*) is an explanatory diagram illustrating the structure of the cover when the cover is closed completely;

FIG. 8(*b*) is a cross-sectional view corresponding to the cross section X-X in FIG. 2 when the nip release lever in FIG. 8(*a*) in a weak pressing position;

FIG. 8(*c*) is a rear view of the nip release lever in FIG. 8(*a*) shown in the weak pressing position;

FIG. 12(*b*) is a perspective view of the nip release lever from the opposite side of that in FIG. 12(*a*);

FIG. 13(*b*) is a cross-sectional view of the fixing device according to the third embodiment taken along the line Y-Y in FIG. 10 when the fixing device is in an envelope mode;

FIG. 13(*c*) is a cross-sectional view of the fixing device when a distal end of a release arm of the nip release lever contacts a release surface;

FIG. 14(*b*) is a cross-sectional view of the fixing device according to the third embodiment when the cover has been closed completely;

DETAILED DESCRIPTION

Figure 1:
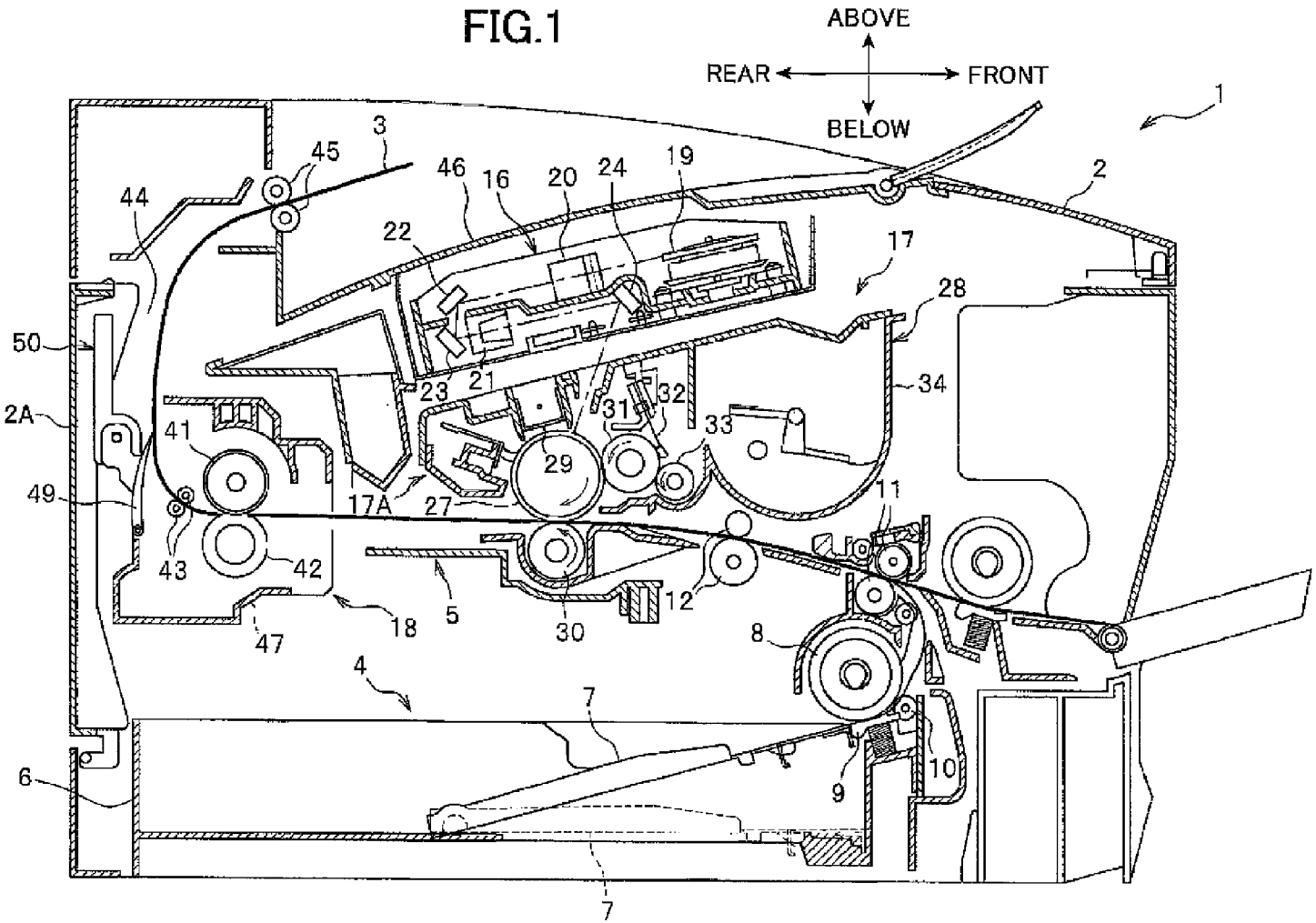
FIG. 1 is a side cross-sectional view of a laser printer according to a first embodiment of the invention.

An image forming device according to some embodiments of the invention will be described while referring to the accompanying drawings wherein like parts and components are designated by the same reference numerals to avoid duplicating description, Note that in the following description, the expressions "front," "rear," "left," "right," "above," and "below" are used to define the various parts when the image forming device is disposed in an orientation in which it is intended to be used.

First, a laser printer 1 as an example of image forming device according to a first embodiment of the invention will be described while referring to FIGS. 1 to 6(*b*).

As shown in FIG. 1, the laser printer 1 includes a main casing 2, and within the main casing 2, a feeder unit 4 for feeding recording paper 3 and an image-forming unit 5 for forming prescribed images on the fed recording paper 3.

The feeder unit 4 includes a paper supply tray 6 detachably mounted in the bottom section of the main casing 2, a paper pressing plate 7 disposed inside the paper supply tray 6, a paper supply roller 8 and a paper supply pad 9 disposed above one end of the paper supply tray 6, paper dust removing rollers 10, 11 disposed downstream of the paper supply roller 8 with respect to a paper feed direction in which the recording paper 3 is conveyed, and registration rollers 12 disposed downstream of the paper dust removing rollers 10, 11 with respect to the paper feed direction.

In the feeder unit 4 having this construction, the recording paper 3 supported in the paper supply tray 6 is moved toward the paper supply roller 8 by the paper pressing plate 7, fed by the paper supply roller 8 and the paper supply pad 9 one sheet at a time, and conveyed by the paper dust removing rollers 10, 11 and the registration rollers 12 to the image forming unit 5.

The image forming unit 5 includes a scanner unit 16, a process cartridge 17, and a fixing device 18

The scanner unit 16 is provided in the upper section of the main casing 2 and is provided with a laser emitting section (not shown), a polygon mirror 19 that is driven to rotate, lenses 20 and 21, and reflection mirrors 22, 23, and 24. The laser emitting section emits a laser beam based on desired image data As indicated by single-dot chain line in FIG. 1, the laser beam passes through or is reflected by the polygon mirror 19, the lens 20, the reflection mirrors 22 and 2.3, the lens 21, and the reflection mirror 24 in this order so as to irradiate, in a high speed scanning operation, the surface of a photosensitive drum 27 of the process cartridge 17.

The process cartridge 17 is detachably mounted in the main casing 2 below the scanner unit 16. The process cartridge 17 includes a casing 17A that is hollow inside and that functions as an outer frame of the process cartridge 17. Disposed inside the casing 17A are a developing cartridge 28, the photosensitive drum 27, a Scorotron charger 29, and a transfer roller 30.

The developing cartridge 28 is detachably mounted in the casing 17A. The developing cartridge 28 is formed with a toner hopper 34 and provided with a developing roller 31, a thickness-regulating blade 32, and a supply roller 33. A toner accommodated in the toner hopper 34 is supplied to the developing roller 31 as the supply roller 33 rotates in a direction indicated by an arrow (counterclockwise direction in FIG. 1). At this time, the toner is positively tribocharged between the supply roller 33 and the developing roller 31. As the developing roller 31 rotates in a direction indicated by an arrow (counterclockwise direction in FIG. 1), the toner supplied onto the developing roller 31 passes beneath the thickness-regulating blade 32 so that a thin layer of toner having a uniform thickness is carried on the surface of the developing roller 31.

The photosensitive drum 27 is supported in the casing 17A so as to be rotatable in a direction indicated by an arrow (clockwise in FIG. 1). The photosensitive drum 27 is formed of a main drum that is grounded. The surface of the main drum is a positively charging photosensitive layer formed of polycarbonate or the like.

The Scorotron charger 29 is disposed above the photosensitive drum 27 and is spaced away from the photosensitive drum 27 by a predetermined space so as to avoid direct contact with the photosensitive drum 27. The Scorotron charger 29 is a positive-charge Scorotron type charge unit for generating a corona discharge from a tungsten charge wire, for example, to uniformly charge the surface of the photosensitive drum 27 with a positive polarity.

The transfer roller 30 is supported in the casing 17A at a position below and in contact with the photosensitive drum 27 so as to be rotatable in a direction indicated by an arrow (counterclockwise direction in FIG. 1). The transfer roller 30 includes a metal roller shaft covered with electrically-conductive rubber material. During a transfer operation, a transfer bias is applied to the transfer roller 30 through constant current control.

With this construction, the Scorotron charger 29 forms a uniform positive charge over the surface of the photosensitive drum 27. Subsequently, the surface of the photosensitive drum 27 is exposed by the high-speed scanning of the laser beam emitted from the scanner unit 16. This drops a potential at areas of the surface of the positively and uniformly charged photosensitive drum 27 that were exposed to the laser beam, thereby forming electrostatic latent images on the surface of the photosensitive drum 27 based on prescribed image data. Note that the electrostatic latent image means the areas of the surface of the uniformly charged photosensitive drum 27 that were exposed to the laser beam and, therefore, have a lower potential than the rest of the surface. When the toner carried on the surface of the developing roller 31 opposes and contacts the photosensitive drum 27 as the developing roller 31 rotates, the toner is selectively supplied to the electrostatic latent images on the surface of the photosensitive drum 27. As a result, the electrostatic latent images on the photosensitive drum 27 are transformed into visible toner images. In this way, a reverse development is performed.

Subsequently, the photosensitive drum 27 and the transfer roller 30 are driven to rotate while sandwiching the recording paper 3 so as to convey the recording paper 3. The toner image carried on the surface of the photosensitive drum 27 is transferred onto the recording paper 3 as the recording paper 3 is conveyed between the photosensitive drum 27 and the transfer roller 30.

The fixing device 18 is disposed downstream of the process cartridge 17 in the paper feed direction. The fixing device 18 includes a heating roller 41, a pressure roller 42, and a pair of conveying rollers 43. The pressure roller 42 presses against the heating roller 42, and the conveying rollers 43 are disposed downstream of the heating roller 41 and the pressure roller 42.

In the fixing device 18 having this construction, the toner image transferred onto the recording paper 3 is thermally-fixed to the recording paper 3 while the recording paper 3 passes between the heating roller 41 and the pressure roller 42. Thereafter, the recording paper 3 is conveyed to a discharge path 44 by the conveying rollers 43 and a flapper 49. After being transported to the discharge path 44, the recording paper 3 is discharged onto a discharge tray 46 by discharge rollers 45.

The portion of the main casing 2 on the rear side is a cover 2A that is capable of partially opening and closing to expose or cover the fixing device 18.

Figure 2:
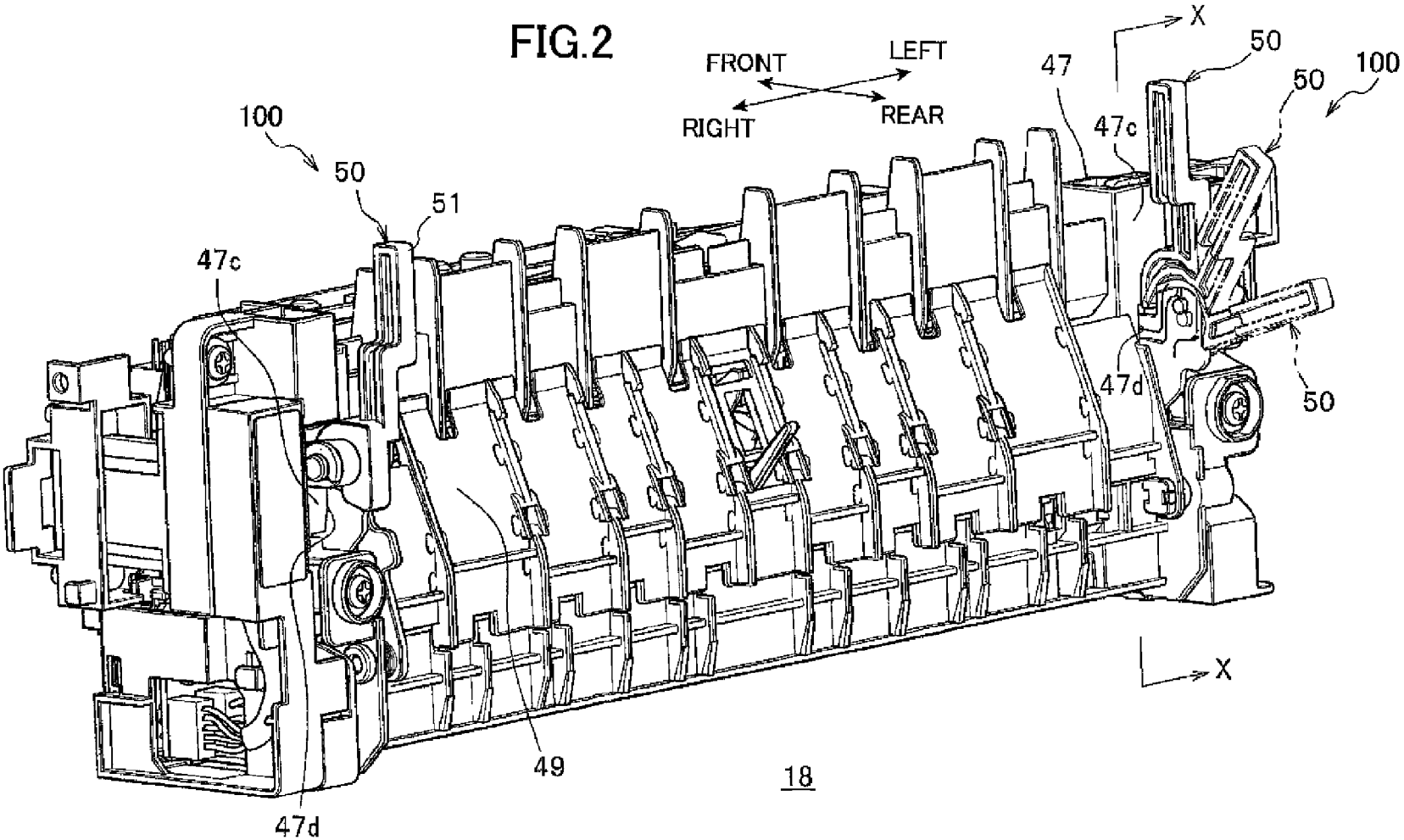
FIG. 2 is a perspective view from the rear side of a fixing device in the laser printer in FIG. 1.

As shown in FIG. 2, the fixing device 18 further includes a frame 47 and a pair of nip release mechanisms 100 each provided at both left and right sides of the frame 47. Each nip release mechanism 100 includes a nip release lever 50 that places the pressure roller 42 in a nip state when rotated upward and places the pressure roller 42 in a nip release state when rotated downward to the rear (indicated by dotted lines in FIG. 2).

Figure 3:
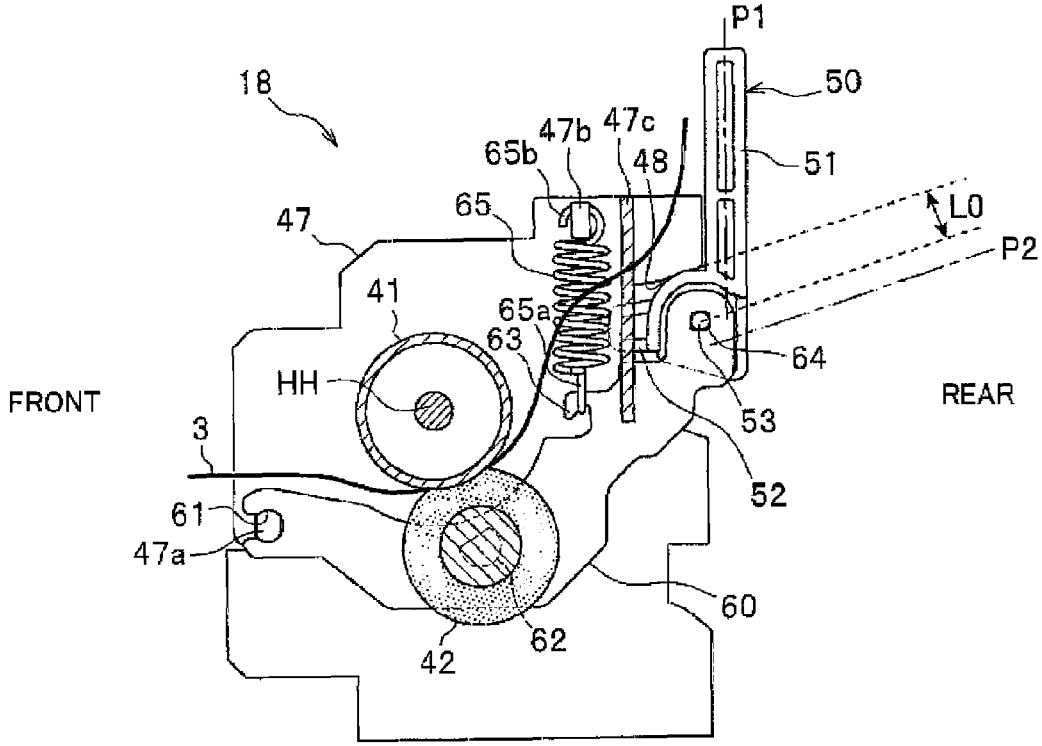
FIG. 3 is a side cross-sectional view of the fixing device taken along a line X-X in FIG. 2 when a pressure roller is in a nip state.
Figure 4:
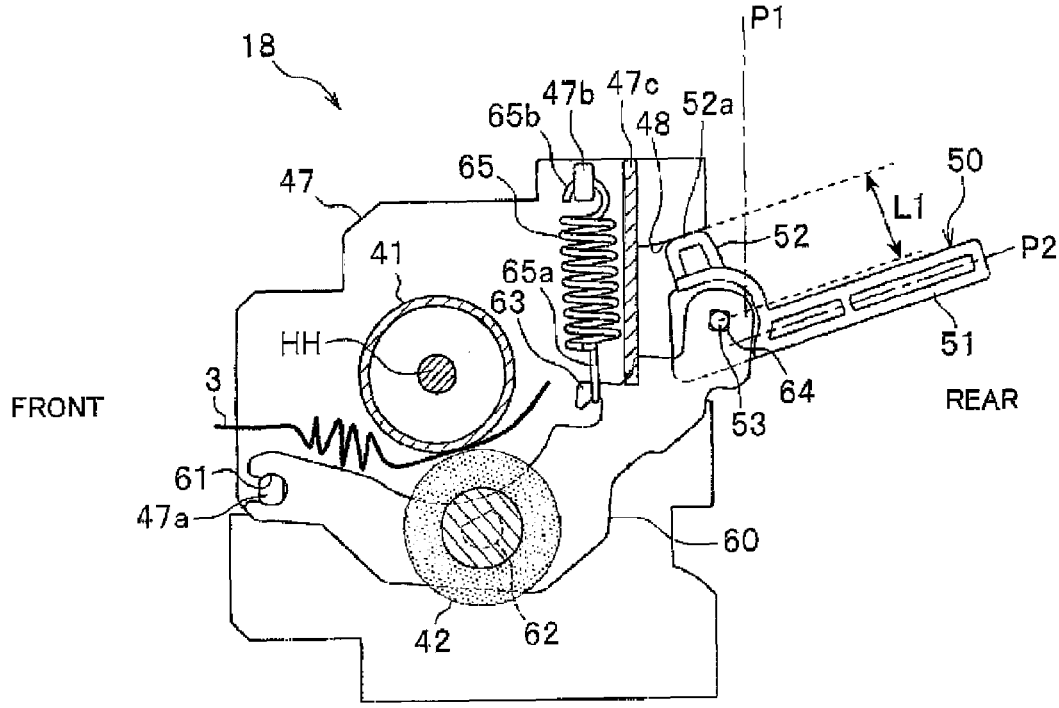
FIG. 4 is a side cross-sectional view of the fixing device taken along a line X-X in FIG. 2 when the pressure roller is in a nip release state.

The left and right nip release mechanisms 100 are formed symmetrical left to right. FIG. 3 is a side cross-sectional view of the fixing device 18 taken along the line X-X in FIG. 2 when the pressure roller 42 is in the nip state. FIG. 4 is a side cross-sectional view of the fixing device 18 taken along the line X-X in FIG. 2 when the pressure roller 42 is in the nip release state.

As shown in FIG. 3, each of the nip release mechanisms 100 further includes a pressure arm 60 that is formed of a metal plate elongated in the front-to-rear direction. A circular cutout 61 is formed in the front end of the pressure arm 60. A support shaft 47*a* provided on the frame 47 is supported in the cutout 61.

The heating roller 41 and the pressure roller 42 are accommodated in the frame 47. A halogen heater HH is built into the heating roller 41. The heating roller 41 is rotatably supported in the frame 47.

Both ends of the pressure roller 42 are rotatably supported in the pressure arms 60 in the center region of the pressure arms 60 with respect to the front-to-rear direction. Specifically, resin bearings 62 are fitted into the approximate center of the pressure arms 60, and a rotational shaft (not shown) of the pressure roller 42 is inserted into the bearings 62.

A hook 63 is formed in the upper section of the pressure arm 60 slightly rearward of the center point. The hook 63 engages with a bottom end 65*a* of a spring 65. An upper end 65*b* of the spring 65 is engaged with a hook 47*b* provided on the frame 47. The spring 65 constantly generates a pulling force for pulling the pressure arm 60 about the support shaft 47*a*. This pulling force produces a force for pressing the pressure roller 42 against the heating roller 41.

A rectangular support hole 64 is formed in the rear end of each pressure arm 60. A rotational shaft 53 on the nip release lever 50 is inserted through the support hole 64, enabling the nip release lever 50 to rotate about the support hole 64. Hence, the nip release lever 50 is rotatably supported on the pressure arm 60 at a position separated from the support shaft 47*a*, which is the pivoting center of the pressure arm 60.

The nip release lever 50 includes a lever part 51 functioning as a user-operated part, and a release arm 52. Both the lever part 51 and the release arm 52 extend more or less radially from the rotational shaft 53. The nip release lever 50 is configured to halt in a pressing position P1 in which the lever part 51 points upward, and a release position P2 in which the lever part 51 is angled along an upward slope. The lever part 51 and the release arm 52 have a prescribed positional relationship. In the example of FIG. 3, the release arm 52 extends forward when the lever part 51 points upward. In the pressing position P1, the lever part 51 is oriented to be accommodated within the cover 2A (see FIG. 1) of the fixing device 18. In the release position P2, the lever part 51 protrudes toward the cover 2A side.

As shown in FIG. 4, a distal end 52*a* of the release arm 52 has a flat contour. A portion of the frame 47 protrudes rearward above the release arm 52. A release surface 48 is formed on this protruding portion as a flat surface facing the rotational shaft 53 of the nip release lever 50. When the nip release lever 50 is rotated downward toward the rear as shown in FIG. 4, the distal end 52*a* of the release arm 52 contacts and engages with the release surface 48.

The release arm 52 has a length L1 (see FIG. 4) sufficient for contacting the release surface 48 and pressing the pressure arm 60 downward. In other words, the distance from the distal end 52*a* to the rotational axis of the release arm 52 (center of the rotational shaft 53), i.e. the length L1, is set greater than a distance L0 (see FIG. 3) from the rotational axis to the release surface 48 when the pressure roller 42 is in the nip state.

In the fixing device 18 having the above construction, the lever part 51 points upward when the nip release lever 50 is in the pressing position P1 shown in FIG. 3. Accordingly, the release arm 52 points forward, separating from the release surface 48 of the frame 47. Hence, the release arm 52 is in a free state and does not contact the frame 47*e* As a result, the pulling force that the spring 65 applies to the pressure arm 60 is transferred directly as a pressing force on the pressure roller 42, thereby forming a nip state with the paper 3.

Paper jams can occur between the heating roller 41 and the pressure roller 42 when printing with the laser printer 1 if the recording paper 3 becomes wrinkled or warped. When such a paper jam occurs, the user must first open the cover 2A by rotating the cover 2A outward and downward. Next, the user rotates the nip release lever 50 rearward to the release position P2, at which time the release arm 52 rotates to an upward facing position so that the distal end 52*a* opposes and contacts the release surface 48, engaging the nip release lever 50 with the frame 47 and pushing the pressure arm 60 downward. At this time, the distal end 52*a* of the release arm 52 faces the heating roller 41 side with respect to a direction linking the heating roller 41 and the pressure roller 42. By pressing against the release surface 48, the release arm 52 receives the pulling force of the spring 65, suppressing the force with which the pressure arm 60 is pulled toward the heating roller 41, so as to form a prescribed gap between the heating roller 41 and the pressure roller 42. This state is the nip release state. The same operation may be performed on both left and right nip release levers 50. By setting the fixing device 18 in this nip release state, the user can easily remove a recording paper 3 jammed between the heating roller 41 and the pressure roller 42.

After resolving the paper jam, the user rotates the left and right nip release levers 50 forward to the pressing position P1, restoring the nip state of the heating roller 41 and the pressure roller 42. Finally, the user closes the cover 2A, completing the process.

Figure 5:
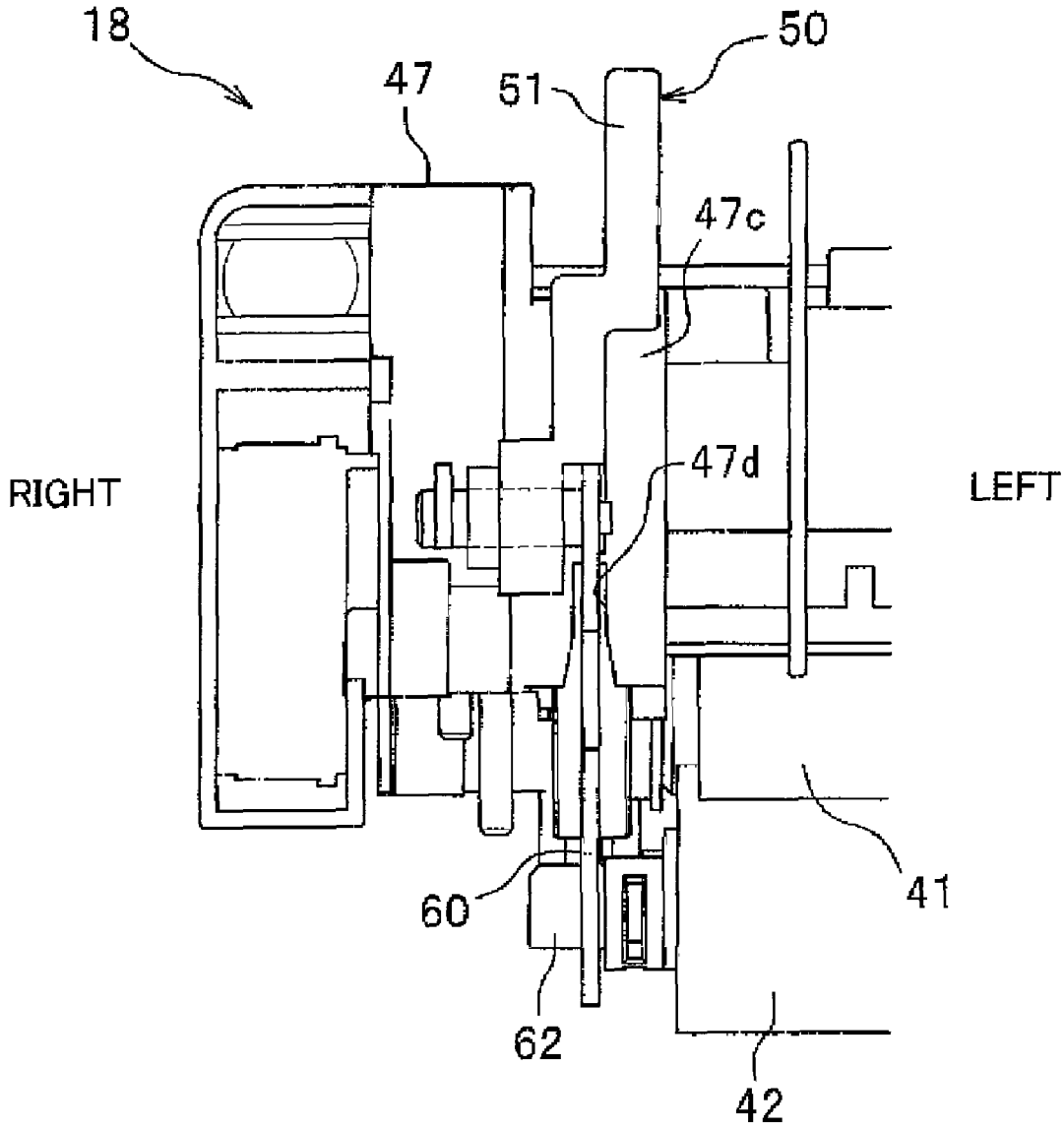
FIG. 5 is a rear view of a pressure arm and a nip release lever on the right side of the fixing device.

FIG. 5 is a rear view of the pressure arm 60 and the nip release lever 50 on the right side of the fixing device 18. As shown in FIG. 5, vertical slits 47*d* are formed as cutouts in a rear wall 47*c* of the frame 47 in regions corresponding to the positions of the pressure arms 60. The width of the slits 47*d* is slightly greater than the thickness of the pressure arms 60. At least part of the pressure arms 60 is inserted through the corresponding slits 47*d* at all times within the pivoting range of the pressure arms 60. Accordingly, the pressure arms 60 always penetrate the slits 47*d* formed in the rear wall 47*c* during operations of the pressure arms 60 shown in FIGS. 3 and 4, so that the pressure arms 60 can be smoothly operated without jiggling left and right.

Figure 6B:
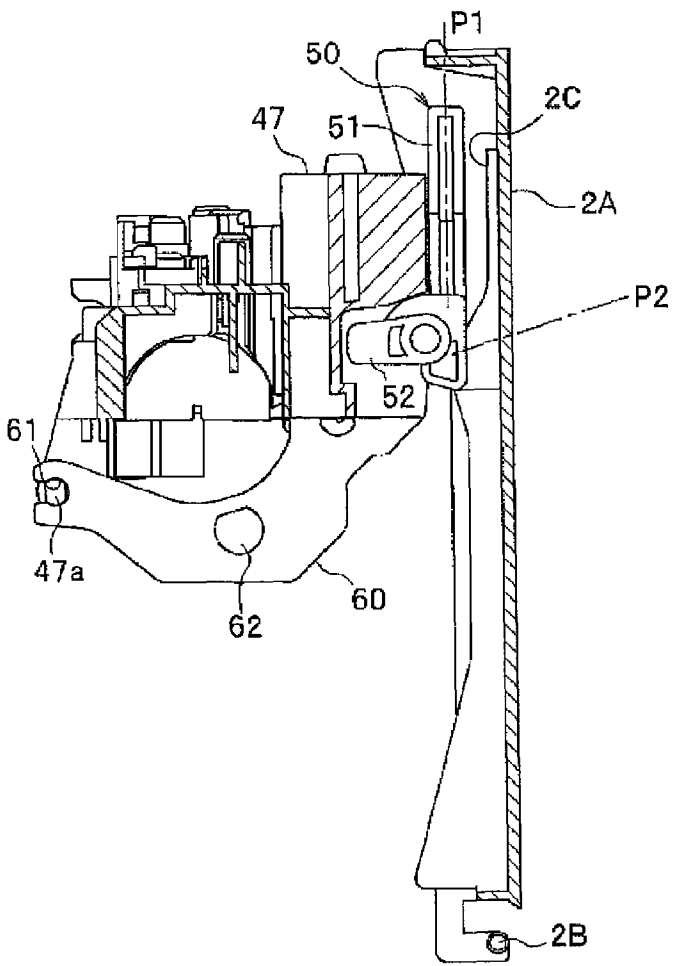
FIG. 6(*a*) is an explanatory diagram illustrating the structure of a cover for the fixing device when the cover is beginning to be closed.
Figure 6A:
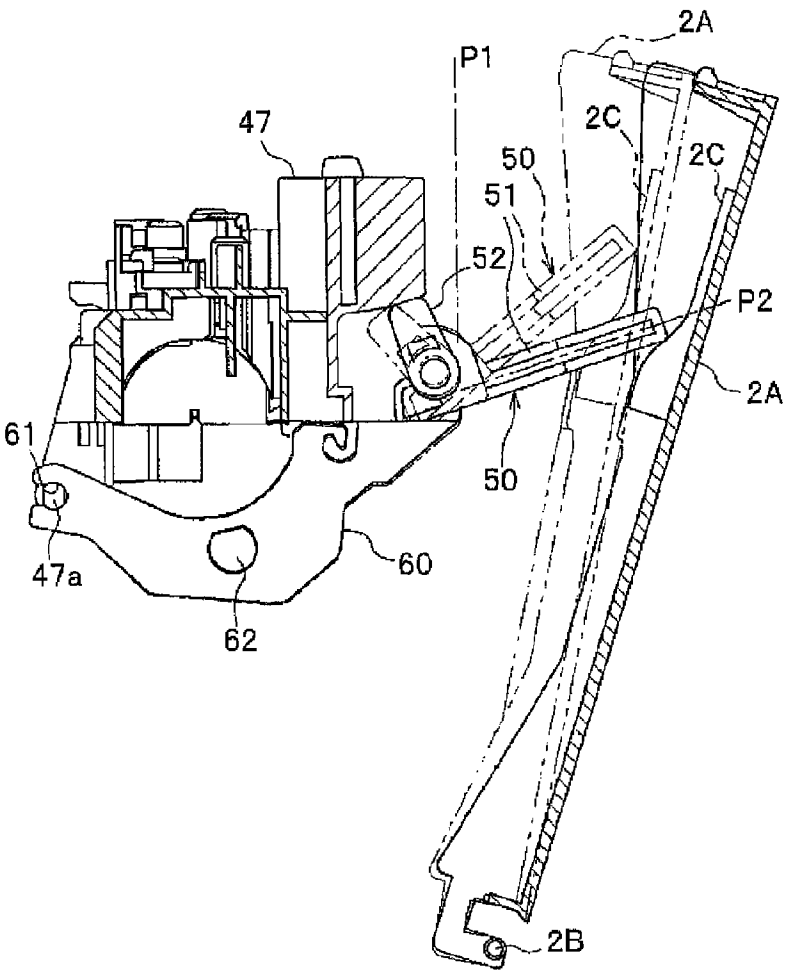

FIG. 6(*a*) shows the state of the fixing device 18 when beginning to close the cover 2A, while FIG. 6(*b*) shows the state of the fixing device 18 when the cover 2A is closed completely As shown in FIG. 6(*a*), the lower edge of the cover 2A is rotatably supported on the main casing 2 by a support shaft 2B. A plurality (only one is shown in FIG. 6) of ribs 2C extending vertically is juxtaposed along the inner surface of the cover 2A. The ribs 2C are formed in the shape of curved ridges protruding farther from the cover 2A on the lower side than on the upper side. The ribs 2C are positioned to contact the lever parts 51 of the nip release levers 50 in the release position P2 when closing the cover 2A and are formed so that the lever parts 51 are accommodated in the cover 2A when the cover 2A is in the closed state.

Hence, it is not necessarily required to directly operate the nip release levers 50 for returning the pressure roller 42 to the nip state. As shown in FIG. 6(*a*), the user may close the cover 2A while the nip release levers 50 are in the release position P2. In such a case, the ribs 2C on the cover 2A impact the lever parts 51 of the nip release levers 50, rotating the nip release levers 50 from the release position P2 shown in FIG. 6(*a*) to the pressing position P1 shown in FIG. 6(*b*). Therefore, the pressure roller 42 is returned to the nip state when the cover 2A is closed.

The fixing device 18 according to the first embodiment described above can be achieved with a simple compact structure that enables the user to release the nip state simply by operating the nip release levers 50 provided on the pressure arms 60. Moreover, the nip release lever 50 can be halted in the release position P2 when the distal end 52*a* of the release arm 52 contacts and engages with the release surface 48. Hence, the user need not maintain pressure on the nip release lever 50 when removing jammed paper. Further, after removing the jammed paper, the user can return the left and right nip release levers 50 to the pressing position P1 simultaneously by closing the cover 2A.

By providing one each of the pressure arms 60 and the nip release levers 50 being left-and-right symmetrical on both ends of the pressure roller 42, the user can release the nip state by performing an operation from the left or right side of the fixing device 18, thereby facilitating the operation to remove jammed paper Further, since the nip release state in the fixing device 18 according to the first embodiment is configured simply by the nip release levers 50 provided directly on the pressure arms 60, the positional relationship of the heating roller 41 and the pressure roller 42 can be set with greater precision.

Next, a fixing device 118 according to a second embodiment of the invention will be described with reference to FIG. 7.

The fixing device 118 differs from the fixing device 18 described above in that a weak pressing state can be formed between the pressure roller 42 and the heating roller 41 by a second pressing force weaker than a first pressing force generated between the pressure roller 42 and the heating roller 41 when the nip release levers 50 are at the pressing position P1.

The following description will cover only portions of the second embodiment that differ from the first embodiment.

Figure 7:
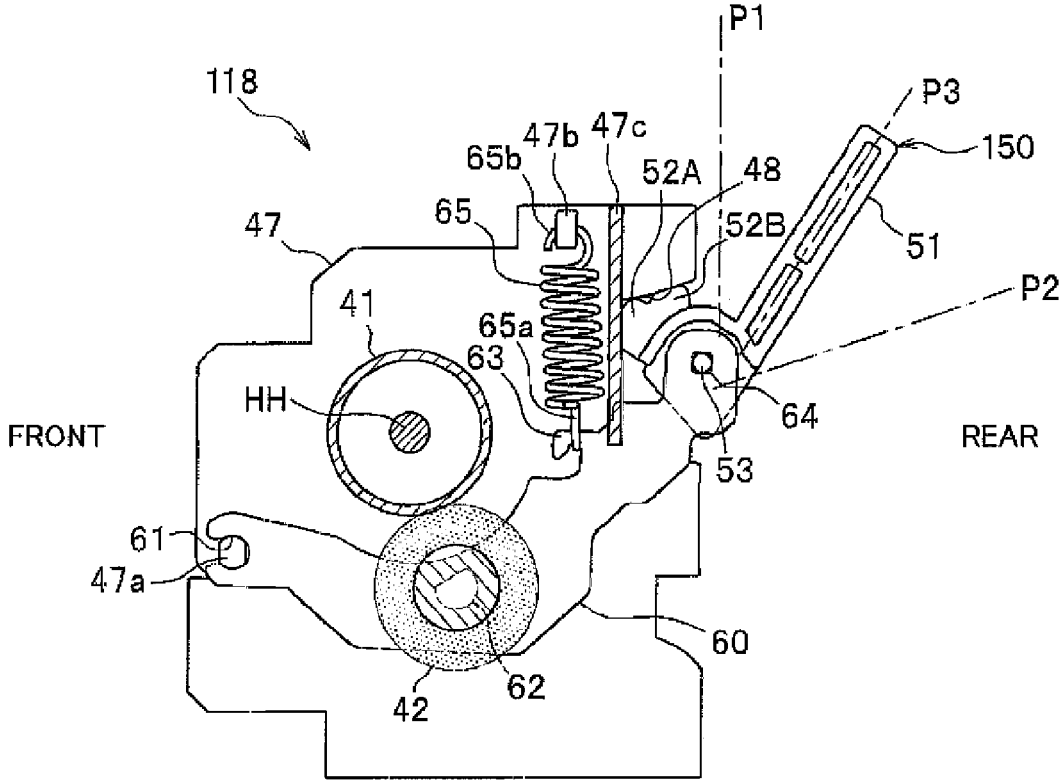
FIG. 7 is a cross-sectional view of a fixing device according to a second embodiment corresponding to the cross section X-X in FIG. 2.

FIG. 7 is a cross-sectional view of the fixing device 118 corresponding to the cross section X-X in FIG. 2. As shown in FIG. 7, a nip release lever 150 of the fixing device 118 is configured of a release arm 52A and a weak pressure release arm 52B in place of the release arm 52 described in the first embodiment.

The release arm 52A has the same shape and orientation as the release arm 52 according to the first embodiment. When the nip release lever 150 is moved to the release position P2, the distal end of the release arm 52A contacts the release surface 48 to produce the nip release state.

The weak pressure release arm 52B also has a flat distal end similar to the release arm 52A, but the distal end of the weak pressure release arm 52B is displaced to the rear side of the release arm 52A. Further, the weak pressure release arm 52B is formed so that the distance from the rotational shaft 53 to the distal end of the weak pressure release arm 52B is smaller than the distance from the rotational shaft 53 to the distal end of the release arm 52A (these distances will be referred to as the "length" of the release arm 52A and the weak pressure release arm 52B). Hence, when the nip release lever 150 is in a weak pressing position P3 between the pressing position P1 and the release position P2, the distal end of the weak pressure release arm 52B contacts and engages with the release surface 48. Since the length of the weak pressure release arm 52B is slightly less than the length of the release arm 52A, the pressure roller 42 is only slightly separated from the nip state. The pressure roller 42 contacts the heating roller 41 with weak pressure when in this slightly separated state. This state is ideal for gripping a thick paper of paper, envelope, or the like. Hence, the pressure roller 42 is preferably set in this weak pressing state when printing on a thick recording paper 3. In this case, printing is performed while the cover 2A is maintained in the open state.

In this way, the fixing device 118 according to the second embodiment applies the ability of the invention to release the nip state with great accuracy in order to produce a weak pressing state with the pressure roller 42.

Next, a fixing device 218 according to a first modification of the second embodiment will be described with reference to FIGS. 8(*a*) to 8(*c*).

Figure 8A:
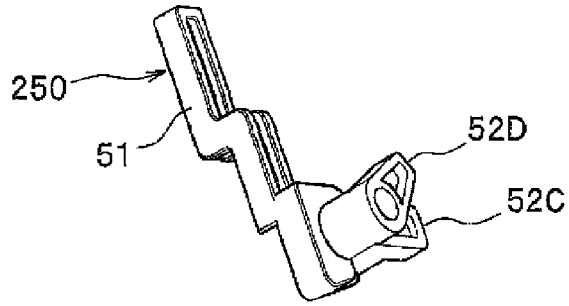
FIG. 8(*a*) is a perspective view of a nip release lever for the fixing device according to a first modification of the second embodiment.
Figure 8B:
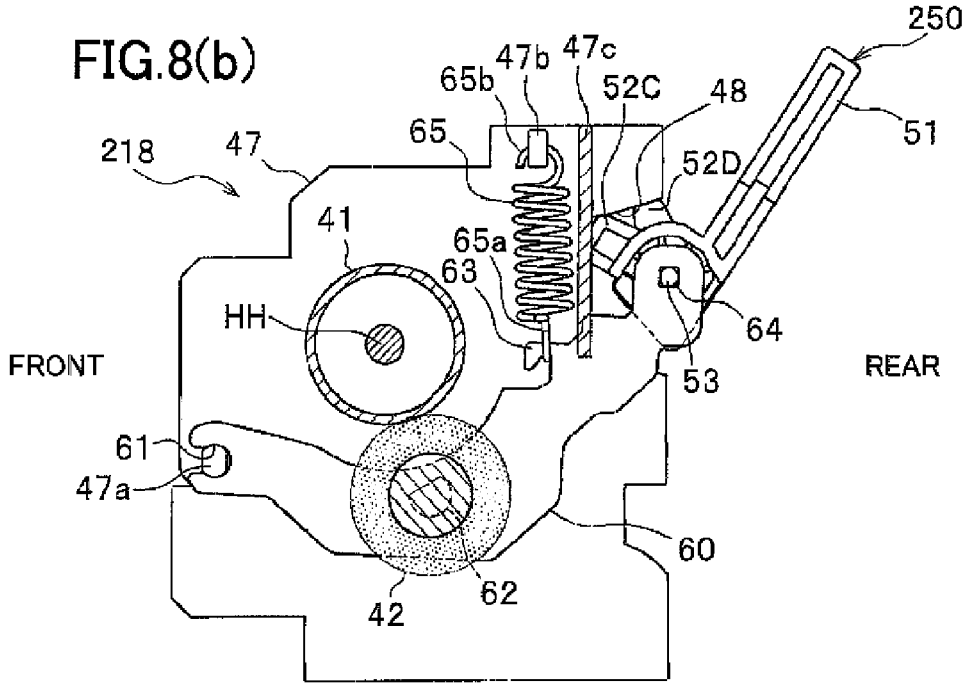
Figure 8C:
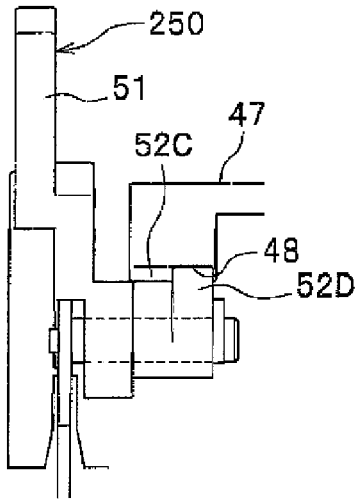

As shown in FIG. 8(*b*), a nip release lever 250 of the fixing device 218 has a release arm 52C for releasing the nip state, and a weak pressure release arm 52D. As shown in FIG. 7, the release arm 52A and the weak pressure release arm 52B in the second embodiment described above are disposed in the same widthwise (left-to-right) position in the fixing device 118. In the first modification of the second embodiment, the release arm 52C and the weak pressure release arm 52D are offset in the axial direction of the nip release lever 250 (width direction of the fixing device 218), as shown in FIGS. 8(*a*) and 8(*c*).

With the construction described above, when the nip release lever 250 is rotated rearward from the pressing position P1, the distal ends of the release arm 52C and the weak pressure release arm 52D sequentially oppose the release surface 48. At this time, the release arm 52C and the weak pressure release arm 52D of the nip release lever 250 engage with the release surface 48 to produce a release state and a weak pressure state, respectively.

Next, a fixing device according to a second modification of the second embodiment will be described with reference to FIG. 9. The fixing device according to the second modification is substantially identical to the fixing device 218 described above, with the following differences.

Figure 9:
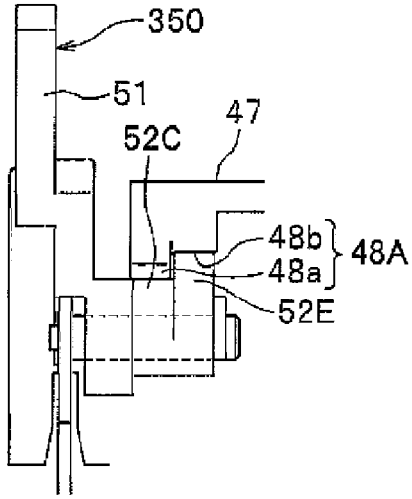
FIG. 9 is a rear view of a nip release lever of a fixing device according to a second modification of the second embodiment, corresponding to the view in FIG. 8(*c*)

As shown in FIG. 9, a nip release lever 350 of the fixing device according to the second modification includes the release arm 52C for forming a release state, and a weak pressure release arm 52E for forming a weak pressure state. A release surface 48A is formed of separate release surfaces 48*a* and 48*b* positioned corresponding to the release arm 52C and the weak pressure release arm 52E. The weak pressure release arm 52E has the same length as the release aim 52C, while the release surface 48*b* is positioned above the release surface 48*a* in FIG. 9. The length of the weak pressure release arm 52E and the position of the release surface 48*b* are appropriately set based on a desired nip state.

With this configuration, a desired pressure or release state can be freely set without restrictions from the layout. This configuration is particularly suitable for forming the weak pressure state in a plurality of steps, for example.

Next, a fixing device 518 according to a third embodiment of the invention will be described with reference to FIGS. 10 to 14.

Figure 10:
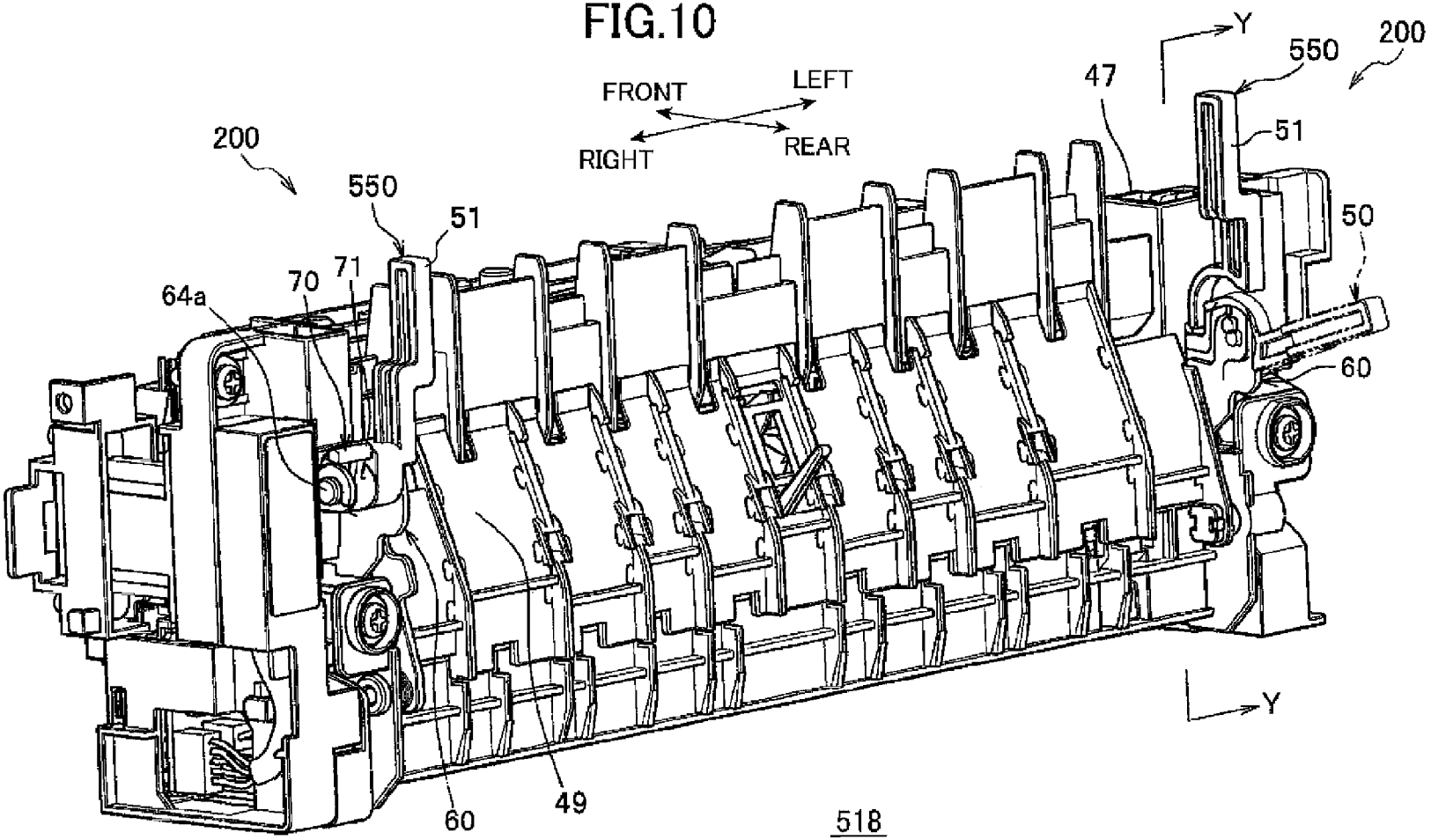
FIG. 10 is a perspective view showing a fixing device according to a third embodiment of the invention from the rear side.

As shown in FIG. 10, a nip release mechanism 200 is disposed on left and right sides of the fixing device 518. Each nip release mechanism 200 includes a nip release lever 550 and an envelope mode lever 70. The nip release levers 550 set the pressure roller 42 in the nip state (hereinafter referred to as the "normal mode") when pointing upward and set the pressure roller 42 in the nip release state (hereinafter referred to as a "nip release mode") when rotated downward toward the rear. The envelope mode levers 70 set the pressure roller 42 in the nip state when pointing upward and set the pressure roller 42 in the weak pressing state (hereinafter referred to as the "envelope mode") for applying weak pressure to the heating roller 41 when rotated downward toward the rear.

Figure 11:
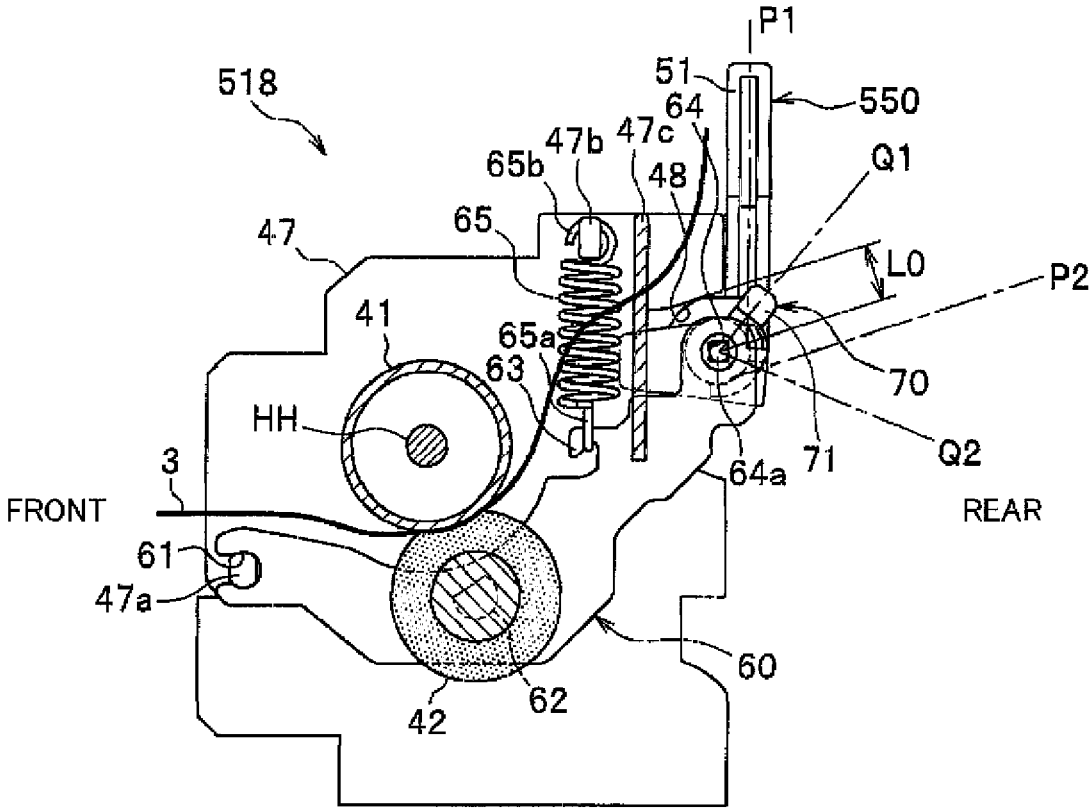
FIG. 11 is a cross-sectional view of the fixing device according to the third embodiment taken along a line Y-Y in FIG. 10 when the fixing device is in a normal mode.
Figures 12A, 12B:
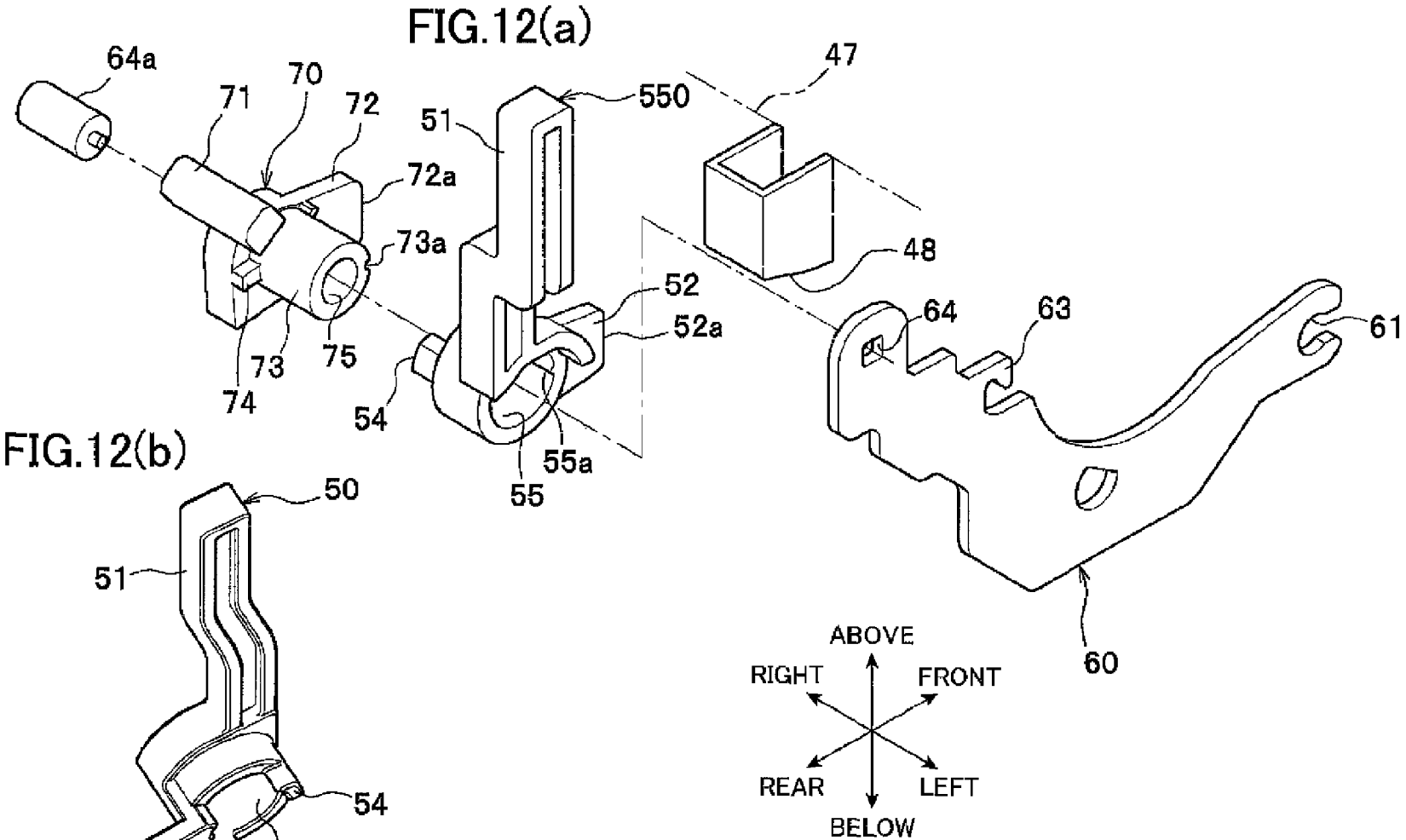
FIG. 12(*a*) is an exploded perspective view of a nip release lever and an envelope mode lever for the fixing device according to the third embodiment.

FIG. 11 is a cross-sectional view of the fixing device 518 according to the third embodiment taken along the line Y-Y in FIG. 10 when the pressure roller 42 is in the normal mode (nip state). FIG. 12(*a*) is an exploded perspective view of the nip release lever 550 and the envelope mode lever 70. FIG. 12(*b*) is a perspective view of the nip release lever 550 from the opposite side of that shown in FIG. 12(*a*).

As shown in FIG. 11, the rectangular support hole 64 is formed in the rear end of the pressure arm 60. A rotational shaft 64*a* of the nip release lever 550 and the envelope mode lever 70 is inserted through the support hole 64 so that the nip release lever 550 and the envelope mode lever 70 can rotate about the rotational shaft 64*a*.

As shown in FIG. 12(*a*), the nip release lever 550 is configured of the lever part 51 and the release arm 52, both of which extend substantially radially from the rotational shaft 64*a*.

A support hole 55 penetrates the nip release lever 550 in the left-to-right direction. A bead 55*a* protrudes from the inner surface of the support hole 55 near the front side thereof and extends in the left-to-right direction, i.e. the axial direction of the support hole 55. A first engaging protrusion 54 protrudes from the side surface of the nip release lever 550 toward the envelope mode lever 70 near the rear side of the rotational shaft 64*a*.

The envelope mode lever 70 includes an operating part 71 that is operated by the user, and a weak pressure release arm 72, both of which extend substantially radially from the rotational shaft 64*a*. The operating part 71 and the weak pressure release arm 72 have a prescribed positional relationship. In this embodiment, the weak pressure release arm 72 faces forward when the operating part 71 slopes diagonally upward to the rear.

Figure 13A:
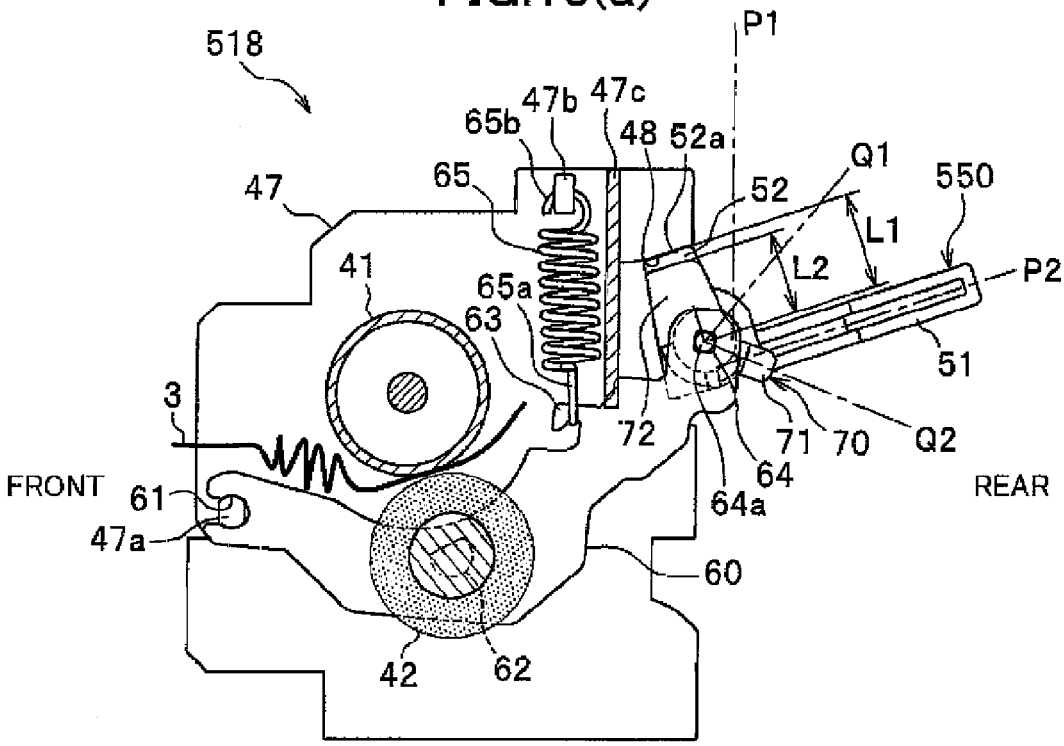
FIG. 13(*a*) is a cross-sectional view of the fixing device according to the third embodiment taken along the line Y-Y in FIG. 10 when the fixing device is in a nip release mode.
Figure 13B:
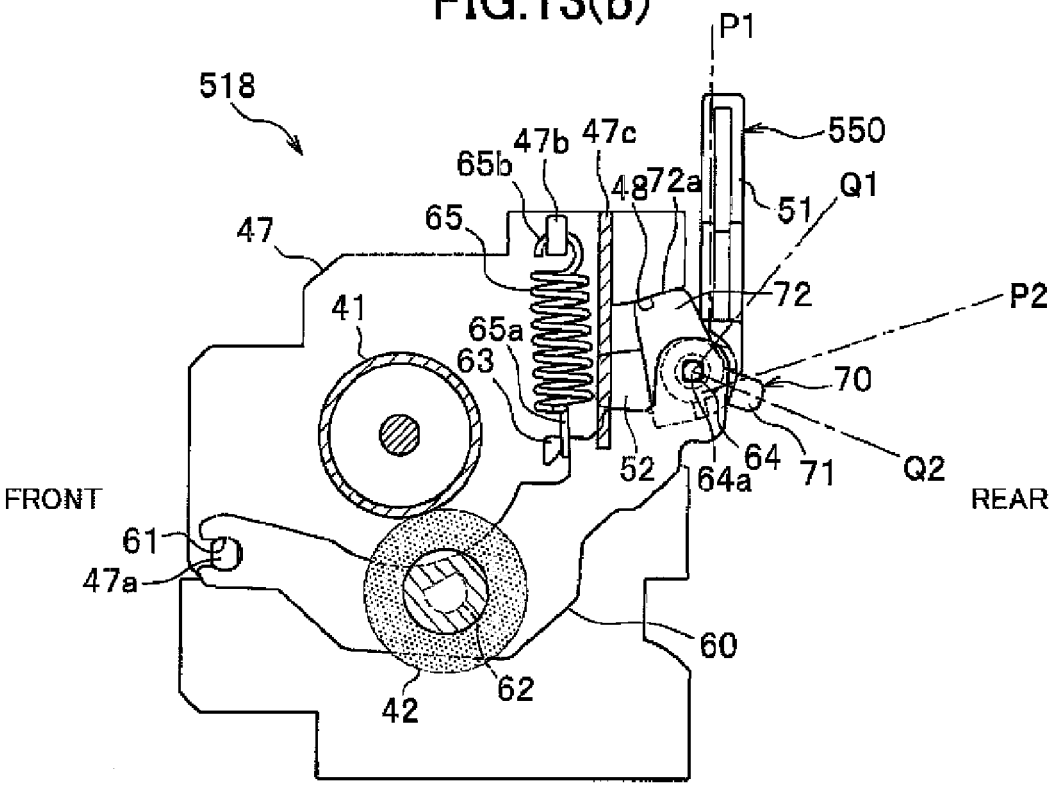
Figure 13C:
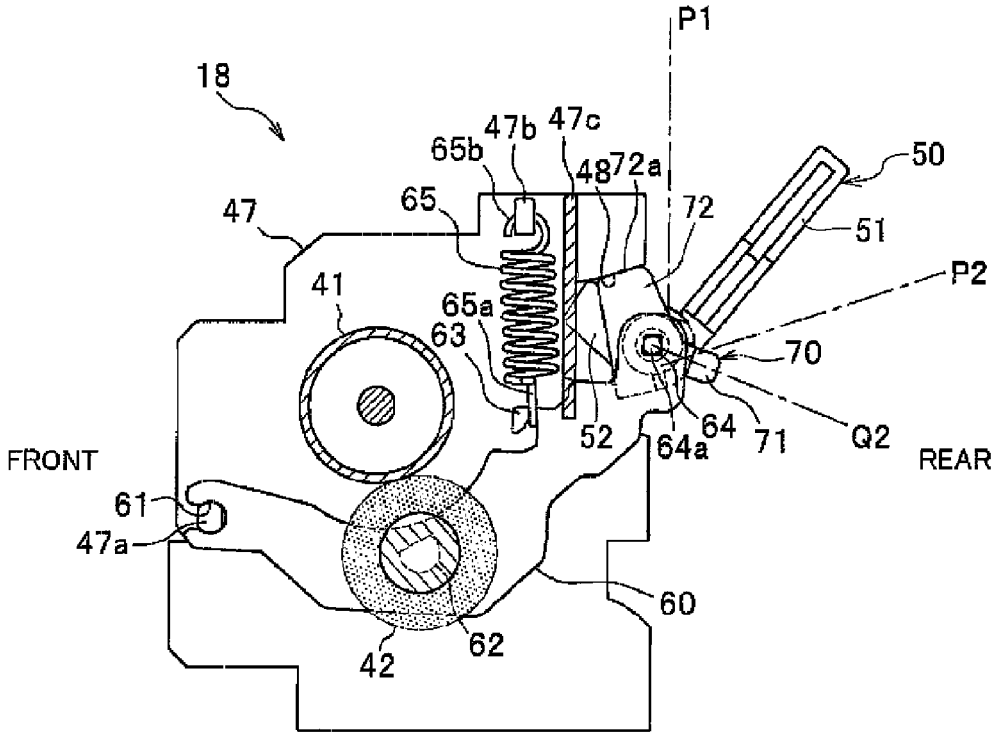

The envelope mode lever 70 is configured to halt in a pressing position Q1 (see FIG. 11) at which the operating part 71 slopes upward to the rear, and a weak pressing position Q2 (see FIG. 13(*a*)) at which the operating part 71 slopes downward to the rear. At the weak pressing position Q2, the operating part 71 points toward the cover 2A side. Unlike the lever part 51, the operating part 71 is elongated in the left-to-right direction. Further, the distance from the rotational shaft 64*a* to the distal end of the operating part 71 is shorter than that to the distal end of the lever part 51, so that the operating part 71 is accommodated inside the cover 2A, whether in the pressing position Q1 or in the weak pressing position Q2.

As shown in FIG. 12(*a*), a distal end 72*a* of the weak pressure release arm 72 is formed with a flat contour. When the operating part 71 is operated to rotate the envelope mode lever 70 downward on the rear side, as shown in FIG. 13(*b*), the distal end 72*a* of the weak pressure release arm 72 contacts and engages with the release surface 48 described above.

A length L2 of the weak pressure release arm 72 (distance from the distal end 72*a* to the rotational axis of the weak pressure release arm 72; see FIG. 13(*a*)) is greater than the length L0 (see FIG. 11) from the rotational axis of the weak pressure release arm 72 to the release surface 48 when the nip release lever 550 and the envelop mode lever 70 are in the pressing position P1 and the pressing position Q1, respectively and less than the length L1 (see FIG. 13(*a*)) of the release arm 52.

As shown in FIG. 12(*a*), a support shaft 73 is formed on the envelope mode lever 70 so as to protrude toward the nip release lever 550. The support shaft 73 is fitted into the support hole 55 of the nip release lever 550. A groove 73*a* extending in the left-to-right direction is formed in the outer peripheral surface of the support shaft 73 on the front side. By engaging the groove 73*a* with the bead 55*a* of the nip release lever 550, the envelope mode lever 70 rotates together with the nip release lever 550 within a prescribed range of torque. A through-hole 75 penetrates the support shaft 73 for inserting the rotational shaft, 64*a*. The through-hole 75 is formed coaxially with the outer periphery of the support shaft 73.

The prescribed torque is set smaller than the torque required for rotating the nip release lever 550 to the release position P2 when the nip release lever 550 and the envelope mode lever 70 are in the pressing position P1 and the pressing position Q1, respectively.

A second engaging protrusion 74 protrudes from the side surface of the envelope mode lever 70 toward the nip release lever 550 for engaging with the first engaging protrusion 54 described above. Since the second engaging protrusion 74 is disposed below the first engaging protrusion 54 on the rear side of the support shaft 73, the second engaging protrusion 74 engages with the first engaging protrusion 54 when the nip release lever 550 is moved downward from the pressing position P1 to the release position P2 and when the envelope mode lever 70 is moved upward from the weak pressing position Q2 to the pressing position Q1. The second engaging protrusion 74 does not engage with the first engaging protrusion 54 in other instances, such as when the nip release lever 550 is moved upward from the release position P2 to the pressing position P1 and when the envelope mode lever 70 is moved downward from the pressing position Q1 to the weak pressing position Q2.

FIG. 13(*a*) illustrates the fixing device 518 in the nip release mode, while FIG. 13(*b*) illustrates the fixing device 518 in the envelope mode.

In the fixing device 518 having the construction described above, the nip release lever 550 is normally in the pressing position P1 and the envelope mode lever 70 is normally in the pressing position Q1, as shown in FIG. 11. This state is the normal mode (pressing state) In the normal mode, the release arm 52 points forward, separating from the release surface 48 of the frame 47. Hence, the release arm 52 is in a free state and does not contact the frame 47. As a result, the pulling force that the spring 65 applies to the pressure arm 60 is transferred directly as a pressing force on the pressure roller 42, thereby forming a nip state with the recording paper 3.

By setting the fixing device 518 in the normal mode when fixing toner images on thin sheets of paper 3 or other normal high-quality paper, the fixing device 518 can suitably convey the paper 3 and fix images thereon.

Paper jams can occur between the heating roller 41 and the pressure roller 42 during printing if the recording paper 3 becomes wrinkled or warped. When such a paper jam occurs, the user must first open the cover 2A by rotating the cover 2A outward and downward. When the lever part 51 of the nip release lever 550 is switched from the pressing position P1 to the release position P2, as shown in FIG. 13(*a*), the release arm 52 rotates in an upward facing direction while pushing the pressure arm 60 downward, and the distal end 52*a* of the release arm 52 contacts the release surface 48 and engages the nip release lever 50 with the frame 47.

At this time, the distal end 52*a* of the release arm 52 faces the heating roller 41 side with respect to the direction linking the heating roller 41 and the pressure roller 42. By pressing against the release surface 48, the release arm 52 receives the pulling force of the spring 65, suppressing the force with which the pressure arm 60 is pulled toward the heating roller 41, so as to form a prescribed gap between the heating roller 41 and the pressure roller 42. This state is the nip release mode. The same operation may be performed on both left and right nip release levers 550. By setting the fixing device 518 in this nip release mode, the user can easily remove a recording paper 3 jammed between the heating roller 41 and the pressure roller 42.

Since the heating roller 41 and the pressure roller 42 do not grip jammed paper 3 in the nip release mode, the user can easily remove the paper 3.

When the user operates the nip release lever 550 to set the fixing device 518 in the nip release mode, the envelope mode lever 70 rotates together with the nip release lever 550 to the weak pressing position Q2 through the engagement of the first engaging protrusion 54 and the second engaging protrusion 74. Since the length L2 of the weak pressure release arm 72 is less than the length L1 of the release arm 52, only the release arm 52 contacts the release surface 48 during this operation. Hence, the envelope mode lever 70 can move along with the movement of the nip release lever 550 without incurring force from the frame 47. Here, the weak pressure release arms 72 do not function, even though the envelope mode levers 70 are in the weak pressing position Q2, because the release arm 52 is setting the nip release mode.

After removing the jammed paper, the user restores the normal mode by rotating the nip release levers 550 from the release position P2 to the pressing position P1. At this time, the envelope mode levers 70 rotate together with the rotation of the nip release levers 550 from the weak pressing position Q2 to the pressing position Q1 through the engagement of the grooves 73*a* and the beads 55*a*. The process is completed by closing the cover 2A.

Figure 14B:
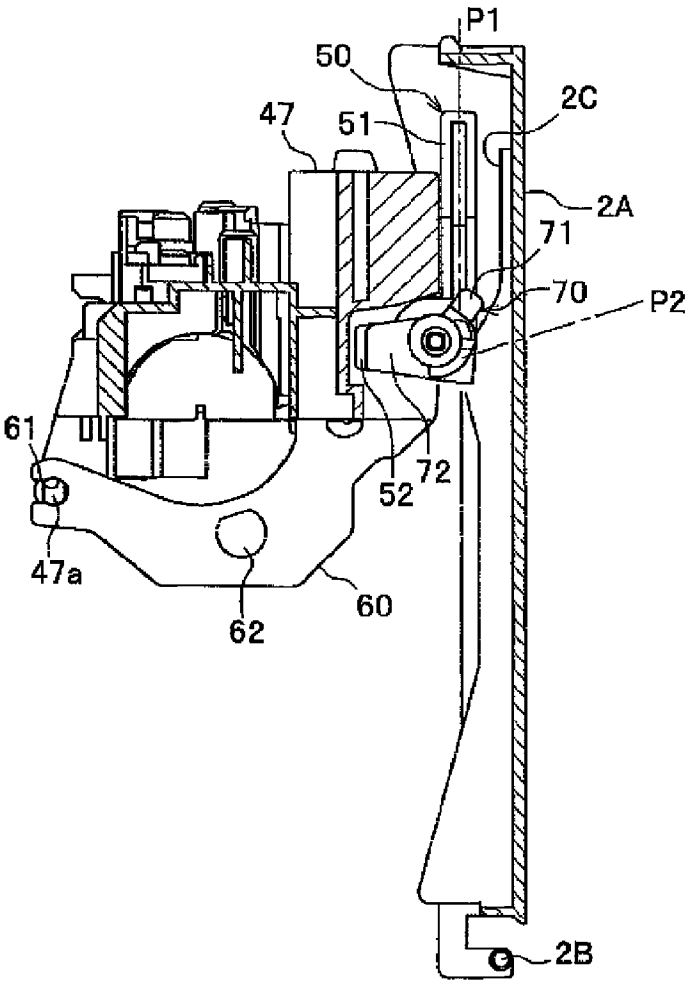
FIG. 14(*a*) is a cross-sectional view of the fixing device according to the third embodiment when a cover is beginning to be closed.
Figure 14A:
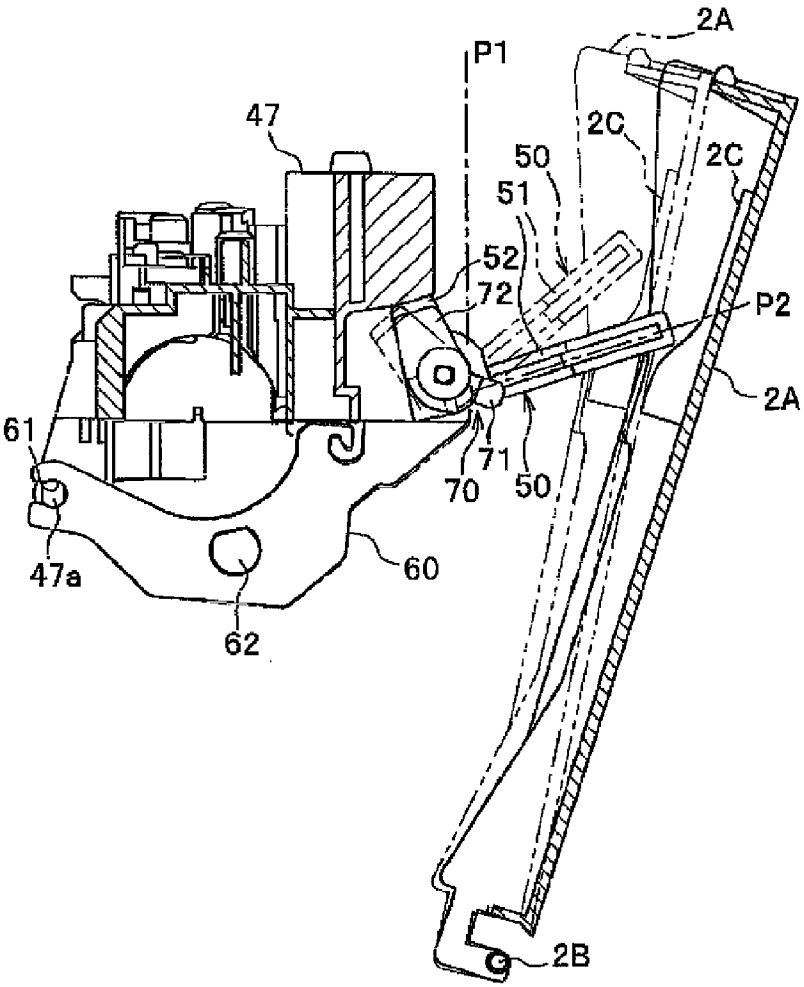

As in the first embodiment described above, it is not necessary to directly operate the nip release lever 550 to restore the normal mode (nip state) in this embodiment. The cover 2A may be closed while the nip release lever 550 is in the release position P2, as shown in FIG. 14(*a*). During this operation, the ribs 2C of the cover 2A impact the lever parts 51 of the nip release levers 550, rotating the nip release levers 550 from the release position P2 shown in FIG. 14(*a*) to the pressing position P1 shown in FIG. 14(*b*). Hence, the nip state is restored when the cover 2A is closed.

Unlike normal high-quality paper, very thin paper or envelopes consisting of paper layered in two sheets may not be conveyed properly if the nip force on the paper 3 is too great. When printing on such a paper 3, the user can open the cover 2A and switch from the normal mode to the envelope mode by rotating the envelope mode lever 70 from the pressing position Q1 to the weak pressing position Q2. Since the groove 73*a* is engaged with the bead 55*a*, the nip release lever 550 in the pressing position P1 also rotates toward the release position P2 together with movement of the envelope mode lever 70. However, as shown in FIG. 13(*c*), an edge of the distal end 52*a* of the release arm 52 contacts the release surface 48 before the nip release lever 550 reaches the release position P2, receiving great resistance from the release surface 48 (frame 47). This resistance causes the bead 55*a* to disengage from the groove 73*a* so that the nip release lever 550 stops rotating before the envelope mode lever 70 reaches the weak pressing position Q2. More specifically, since the torque that enables the nip release lever 550 to rotate together with the envelope mode lever 70 through the engagement of the groove 73*a* and the bead 55*a* is less than the torque required to rotate the nip release lever 550 from the pressing position P1 to the release position P2 against the resistance of the frame 47, the nip release lever 550 cannot follow the envelope mode lever 70 when the envelope mode lever 70 is moved from the pressing position Q1 to the weak pressing position Q2, resulting in only the envelope mode lever 70 being rotated to the weak pressing position Q2.

When the envelope mode lever 70 is in the weak pressing position Q2, the distal end 72*a* of the weak pressure release arm 72 contacts the release surface 48, pushing the pressure arm 60 downward. However, the weak pressure release arm 72 does not push the pressure arm 60 downward enough to separate the pressure roller 42 from the heating roller 41 since the length L2 of the weak pressure release arm 72 is less than the length L1 of the release arm 52, but rather move the pressure roller 42 far enough from the heating roller 41 to grip the paper 3 with a weak force. This state is the envelope mode.

With the envelope mode, the heating roller 41 and the pressure roller 42 grip an envelope or similar type of paper 3 with a suitable force for conveying the paper 3 and fixing an image thereon. As shown in FIG. 14(*b*), the ribs 2C and the operating parts 71 are formed so that the operating parts 71 are accommodated in the cover 2A when the cover 2A is closed, whether the operating parts 71 are in the pressing position Q1 or the weak pressing position Q2. Therefore, when printing in the envelope mode, the user may operate the laser printer 1 with the cover 2A open or closed. In other words, since the operating part 71 is sufficiently small to be accommodated in the cover 2A when the cover 2A is closed, closing the cover 2A does not return the operating mode to the normal mode. Note that although the nip release lever 550 returns to the pressing position P1 at this time, the envelop mode lever 70 does not return to the pressing position Q1 since the engagement between the groove 73*a* and the bead 55*a* has broken (since there is a difference in phase between groove 73*a* and the bead 55*a*). Hence, the laser printer 1 can be operated in the envelope mode after closing the cover 2A.

After completing a printing operation in the envelope mode, the user may open the cover 2A and restore the normal mode by moving the envelope mode lever 70 from the weak pressing position Q2 to the pressing position Q1

The fixing device 518 according to this embodiment can be achieved with a simple compact structure that enables the user to release the nip state simply by operating the nip release levers 550 provided on the pressure arms 60. Moreover, the nip release lever 550 can be halted in the release position P2 when the distal end 52*a* of the release arm 52 contacts and engages with the release surface 48. Hence, the user needs not maintain pressure on the nip release lever 550 when removing jammed paper. Further, after removing the jammed paper, the user can return the left and right nip release levers 50 to the pressing position P1 simultaneously by closing the cover 2A.

Further, the envelope mode can be implemented using only the envelope mode levers 70. In addition, by rotatably providing the nip release levers 550 and the envelope mode levers 70 on the same rotational shaft 64*a*, the release surface 48 functioning as the portion on the frame 47 side that engages with both levers 550 and 70 can be configured of a single continuous surface, thereby simplifying the structure. Further, by providing the nip release levers 550 and the envelope mode levers 70 as separate parts, the lever parts 51 can be formed larger and the operating parts 71 smaller so that the normal mode is restored from the nip release mode when the cover 2A is closed, but the envelope mode is maintained when the cover 2A is closed.

Further, by disposing the first engaging protrusion 54 and the second engaging protrusion 74 on opposing sides of the nip release lever 550 and the envelope mode lever 70 as engaging parts capable of engaging with each other, the user cannot operate the envelope mode lever 70 after setting the nip release mode, effectively preventing the user from performing an incorrect operation.

In addition, the nip release lever 550 and the envelope mode lever 70 are configured to rotate together through the engagement of the groove 73*a* and the bead 55*a*. Accordingly, when the nip release lever 550 is rotated from the nip release mode (release position P2) to the normal mode (pressing position P1), the envelope mode lever 70 is rotates together with the nip release lever 550, returning to the pressing position Q1. This configuration prevents the user from performing an unintended operation.

The fixing device 518 of this embodiment configures the nip release mode with only the nip release levers 550 provided directly on the pressure arms 60 and configures the envelope mode with only the envelope mode levers 70 provided directly on the pressure arms 60. This configuration enables the positional relationship of the heating roller 41 and the pressure roller 42 to be set with precision. Hence, for the first time it is possible to achieve a structure for forming a precise positional relationship between the heating roller 41 and the pressure roller 42 required for forming nip states with minute pressure adjustments, as with the envelope mode.

Further, by providing one each of the pressure arms 60, the nip release levers 550, and the envelope mode levers 70 on both ends of the pressure roller 42 so as to be symmetrical left to right, the nip state between the pressure roller 42 and the heating roller 41 can be adjusted on both left and right sides.

With the fixing device 518 having the construction described above, the distal end 72*a* of the envelope mode lever 70 contacts the frame 47 and move the pressure arm 60 against the urging force of the spring 65 when the envelope mode lever 70 rotatably supported on the pressure arm 60 is rotated about a position (rotational shaft 64*a*) offset from the pivoting center (support shaft 47*a*) of the pressure arm 60. Therefore, this construction weakens the nip force between the heating roller 41 and the pressure roller 42 by slightly moving the pressure arm 60 rotatably supporting the pressure roller 42. Hence, movement of the pressure arm 60 can be implemented with a simple construction in which the envelope mode lever 70 is rotated to engage with the frame 47.

While the invention has been described in detail with reference to the above embodiments thereof, it would be apparent to those skilled in the art that various changes and modifications may be made therein without departing from the spirit of the invention.

Figure 15:
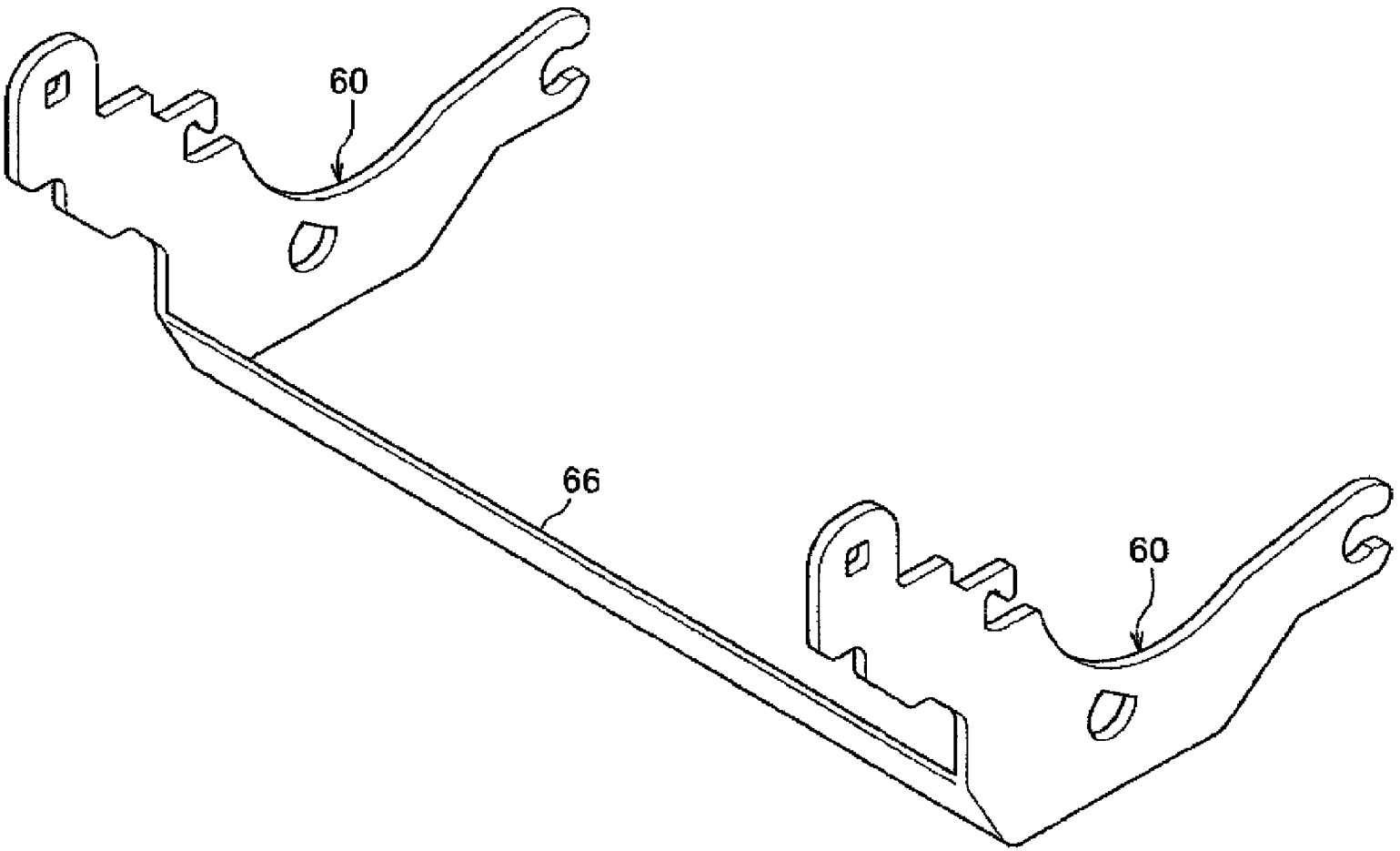
FIG. 15 is a perspective view showing a modification of a pressure arm.
Figure 16:
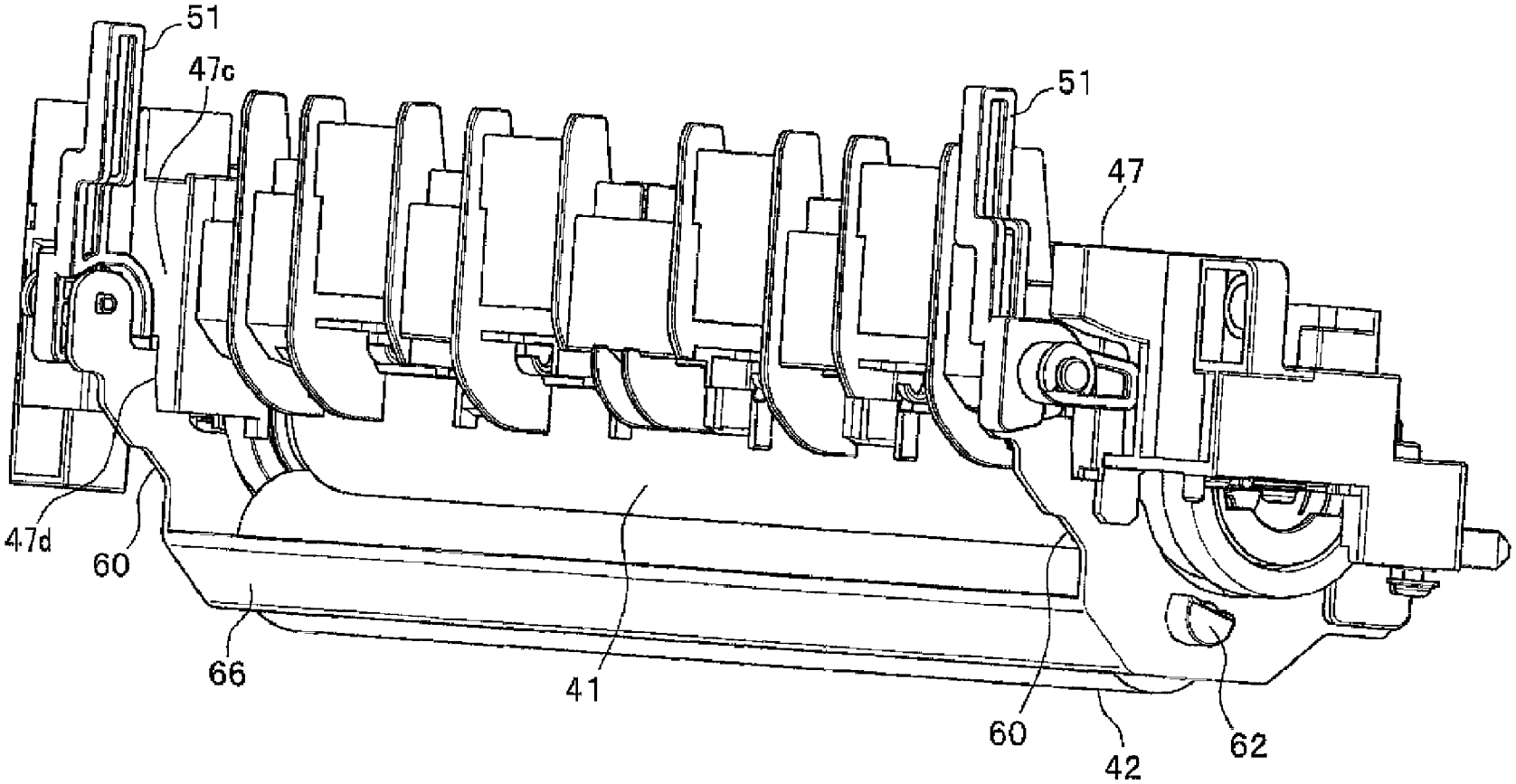
FIG. 16 is a perspective view from the rear side showing the fixing device provided with the pressure arm shown in FIG. 15.

For example, in order to facilitate the operation for resolving a paper jam, the left and right pressure arms 60 may be integrally connected with a connecting bar 66, as shown in FIGS. 15 and 16. When the left and right pressure arms 60 are connected by the connecting bar 66 in this way, if the user operates one of the pressure arms 60 to set the nip release state, the other pressure arm 60 will move in association with the operated pressure arm 60 owing to the connecting bar 66.

Therefore, even when the laser printer 1 is installed in a location with one of the left and right sides adjacent to a wall, the user can reliably change the nip state of the pressure roller 42 simply by operating the nearest nip release lever 50 (150, 250, 350, or 550) or the envelope mode lever 70. Accordingly, the user can easily change the mode for removing jammed paper or for setting the weak pressing state.

The frame 47 may be formed either as a box or a framework. Further, the engagement formed between the nip release levers 50 (150, 250, 350, or 550) or the envelope mode levers 70 and the frame 47 is not limited to contact between flat surfaces, but may also be achieved through engagement of protrusions and depressions. For example, the distal end 52*a* and the distal end 72*a* of the release arm 52 and the weak pressure release arm 72 in the third embodiment may be formed in a pointed shape, while depressions are formed at corresponding positions in the release surface 48 for receiving the distal end 52*a* and the distal end 72*a*.

In the third embodiment described above, the first engaging protrusion 54 and the second engaging protrusion 74 are provided as engaging parts for achieving integral rotation of the envelope mode lever 70 and the nip release lever 550. However, rather than forming protrusions on both the envelope mode lever 70 and the nip release lever 550, it is also possible to form a depression or stepped part in either the envelope mode lever 70 or the nip release lever 550.

In the third embodiment described above, the engagement of the groove 73*a* and the bead 55*a* is used to achieve associated rotation of the envelope mode lever 70 and the nip release lever 550. However, this associated rotation may also be achieved through frictional force between the envelope mode lever 70 and the nip release lever 550. For example, the frictional force between the outer periphery of the support shaft 73 and the inner periphery of the support hole 55 may be used to rotate the envelope mode lever 70 and the nip release lever 550 together.

In the third embodiment described above, the nip release levers 550 and the envelope mode levers 70 are rotatably supported on the pressure arms 60 along the same axis. However, these components may be rotatably supported on the pressure arms 60 along different axes.

In the embodiments described above, the invention is applied to the laser printer 1 as an example of the image-forming device, but the invention may also be applied to other image-forming devices, such as a photocopier and multifunction device.

In the embodiments described above, the transfer roller 30 is employed as an example of transferring means, but the invention may also employ a non-contact transferring means, for example.

In the embodiments described above, the paper 3, including thick paper, thin paper, and postcards, is employed as an example of the recording paper, but the recording paper of the invention may also be transparency papers.

In the embodiments described above, the spring 65 is employed as an example of the urging means, but the urging means may be a compression spring or torsion spring, for example.

In the embodiments described above, the halogen heater HH is employed as an example of the heating source, but the heating source may also be a ceramic heater, an IH heater, or the like.

What is claimed is:

1. A fixing device comprising:

a heating roller;

a pressure roller configured to fix a developer image formed on a recording medium onto the recording medium through cooperative operation with the heating roller;

a frame configured to rotatably support the heating roller;

a pressure arm pivotably supported on the frame and configured to rotatably support the pressure roller; and a pressure releasing member disposed directly on the pressure arm, the pressure releasing member configured to move between a pressing position and a release position so as to move the pressure roller between a first position at which the pressure roller is in pressing contact with the heating roller and a second position at which the pressure roller is separated from the heating roller, the pressure releasing member configured to be halted in the release position, wherein the pressure releasing member is configured to be halted in the release position by engaging with the frame.

2. The fixing device according to claim 1, wherein:

the pressure releasing member includes:

a lever configured to be operated by a user; and a release arm that extends toward a heating roller side with respect to a direction linking the heating roller and the pressure roller when the pressure releasing member is in the release position, the release arm having a distal end that contacts and engages with the frame when the pressure releasing member is in the release position; and the pressure releasing member is configured to be rotatably supported on the pressure arm at a position separated from a pivoting center of the pressure arm.

3. The fixing device according to claim 1, wherein:

the pressure roller is configured to apply a first pressing force to the heating roller when the pressure releasing member is in the pressing position;

the pressure releasing member is configured to be halted at a weak pressing position; and when the pressure releasing member is moved to the weak pressing position, the pressure roller is moved to a third position at which the pressure roller applies a second pressing force to the heating roller, the second pressing force being weaker than the first pressing force.

4. The fixing device according to claim 3, wherein:

the pressure releasing member includes:

a lever configured to be operated by a user;

a release arm that extends toward a heating roller side with respect to a direction linking the heating roller and the pressure roller when the pressure releasing member is in the release position, the release arm having a distal end that contacts and engages with the frame when the pressure releasing member is in the release position; and a weak pressure release arm that extends toward the heating roller side with respect to the direction linking the heating roller and the pressure roller when the pressure releasing member is in the weak pressing position, the weak pressure release arm has a distal end that contacts and engages with the frame when the pressure releasing member is in the weak pressing position; and the pressure releasing member is configured to be rotatably supported on the pressure arm at a position separated from a pivoting center of the pressure arm.

5. The fixing device according to claim 1, wherein the frame is formed with a slit, and at least part of the pressure arm is always inserted through the slit within a range that the pressure arm pivots due to operations of the pressure releasing member.

6. The fixing device according to claim 1, wherein the pressure arms include a first pressure arm and a second pressure arm, the first pressure arm being disposed on one end of the pressure roller, the second pressure arm being disposed on another end of the pressure roller, wherein the pressure releasing member includes a first pressure releasing member and a second pressure releasing member, the first pressure releasing member being provided on the first pressure arm, the second pressure releasing member being provided on the second pressure arm.

7. The fixing device according to claim 6, further comprising a connecting member that integrally connects the first pressure arm and the second pressure arm.

8. An image forming device comprising:

an image forming unit configured to form a developer image on a recording medium; and a fixing device configured to fix the developer image onto the recording medium, the fixing device including:

a heating roller;

a pressure roller configured to fix the developer image onto the recording medium through cooperative operation with the heating roller;

a frame configured to rotatably support the heating roller;

a pressure arm that is pivotably supported on the frame and that rotatably supports the pressure roller; and a pressure releasing member disposed directly on the pressure arm, the pressure releasing member configured to move between a pressing position and a release position so as to move the pressure roller between a first position at which the pressure roller is in pressing contact with the heating roller and a second position at which the pressure roller is separated from the heating roller, the pressure releasing member is configured to be halted in the release position, wherein the pressure releasing member is configured to be halted in the release position by engaging with the frame.

9. The image forming device according to claim 8, further comprising:

a main casing configured to accommodate the image forming unit and the fixing device; and a cover that is disposed on the main casing so as to open and close, wherein:

the pressure releasing member is configured to be halted in the release position by engaging with the frame;

the pressure releasing member includes:

a lever configured to be operated by a user; and a release arm that extends toward a heating roller side with respect to a direction linking the heating roller and the pressure roller when the pressure releasing member is in the release position, the release arm having a distal end that contacts and engages with the frame when the pressure releasing member is in the release position;

the pressure releasing member is rotatably supported on the pressure arm at a position separated from a pivoting center of the pressure arm;

the lever protrudes outside the main casing toward the cover when the pressure releasing member is in the release position and the cover is open;

the lever is accommodated in the main casing without protruding outside the main casing when the pressure releasing member is in the pressing position; and the cover presses the lever of the pressure releasing member in the release position when the cover is closed, thereby returning the pressure releasing member from the release position to the pressing position.

10. The image forming device according to claim 8, further comprising:

a main casing configured to accommodate the image forming unit and the fixing device; and a cover that is disposed on the main casing so as to open and close, wherein:

the pressure roller applies a first pressing force to the heating roller when the pressure releasing member is in the pressing position;

the pressure releasing member is configured to be halted at a weak pressing position;

when the pressure releasing member is moved to the weak pressing position, the pressure roller is moved to a third position at which the pressure roller applies a second pressing force to the heating roller, the second pressing force being weaker than the first pressing force;

the pressure releasing member includes:

a lever that is configured to be operated by a user;

a release arm that extends toward a heating roller side with respect to a direction linking the heating roller and the pressure roller when the pressure releasing member is in the release position, the release arm having a distal end that contacts and engages with the frame when the pressure releasing member is in the release position; and a weak pressure release arm that extends toward the heating roller side with respect to the direction linking the heating roller and the pressure roller when the pressure releasing member is in the weak pressing position, the weak pressure release arm has a distal end that contacts and engages with the frame when the pressure releasing member is in the weak pressing position; and the pressure releasing member is rotatably supported on the pressure arm at a position separated from a pivoting center of the pressure arm.

11. A fixing device comprising:

a heating roller;

a pressure roller configured to fix a developer image formed on a recording medium onto the recording medium through cooperative operation with the heating roller;

a frame that rotatably supports the heating roller;

a pressure arm that is pivotably supported on the frame and that rotatably supports the pressure roller;

a spring that is engaged in the pressure arm and that urges, through the pressure arm, the pressure roller to contact the heating roller with pressure; and a pressing force adjusting member that is pivotably supported directly on the pressure arm at a position separated from a pivoting center of the pressure arm, the pressing force adjusting member including:

an operating part that is configured to be operated by a user; and a weak pressure release arm having a distal end that is configured to contact and engage with the frame to move the pressure arm against the urging force of the spring, thereby producing a weak pressing state in which the urging force applied to the pressure roller by the spring is decreased.

12. The fixing device according to claim 11, further comprising a pressure releasing member separate from the pressing force adjusting member and pivotably supported on the pressure arm at a position separated from the pivoting center of the pressure arm, wherein the pressure releasing member includes a lever that is configured to be operated by a user and a release arm having a distal end that is configured to contact and engage with the frame, thereby separating the pressure roller from the heating roller against the urging force of the spring.

13. The fixing device according to claim 12, wherein the pressing force adjusting member and the pressure releasing member are supported on the pressure arm along the same rotational axis.

14. The fixing device according to claim 13, wherein:

the pressure releasing member is configured to pivot between a first pressing position and a release position so as to move the pressure roller between a first position at which the pressure roller is in pressing contact with the heating roller due to the urging force of the spring and a second position at which the pressure roller is separated from the heating roller against the urging force of the spring;

the pressing force adjusting member has a first side surface having a first engaging part;

the pressure releasing member has a second side surface opposing the first side surface, the second side surface having a second engaging part that is configured to engage with the first engaging part; and engagement of the first and second engaging parts causes the pressing force adjusting member to pivot simultaneously with the pressure releasing member when the pressure releasing member is shifted from the first pressing position toward the release position.

15. The fixing device according to claim 14, wherein the pressing force adjusting member pivots simultaneously with the pressure releasing member when the pressure releasing member is shifted from the release position toward the first pressing position through one of friction and engagement between the pressing force adjusting member and the pressure releasing member.

16. The fixing device according to claim 15, wherein a first torque configured to pivot the pressing force adjusting member and the pressure releasing member together is less than a second torque required to pivot the pressure releasing member from the first pressing position to the release position due to the relationship with the frame.

17. The fixing device according to claim 11, wherein the pressing force adjusting member is pivotable between a second pressing position and a weak pressing position so as to move the pressing roller between a first position at which the pressing roller applies a first pressing force to the heating roller and a third position at which the pressing roller applies a second pressing force to the heating roller, the second pressing force being less than the first pressing force, and the pressing force adjusting member produces the weak pressing state when in the weak pressing position.

18. An image forming device comprising:

an image forming unit configured to form a developer image onto a recording medium; and a fixing device configured to fix the developer image onto the recording medium, the fixing device including:

a heating roller;

a pressure roller configured to fix the developer image onto the recording medium through cooperative operation with the heating roller;

a frame that rotatably supports the heating roller;

a pressure arm that is pivotably supported on the frame and that rotatably supports the pressure roller;

a spring that is engaged in the pressure arm and that urges, through the pressure arm, the pressure roller to contact the heating roller with pressure; and a pressing force adjusting member that is pivotably supported directly on the pressure arm at a position separated from a pivoting center of the pressure arm, the pressing force adjusting member including:

an operating part that is configured to be operated by a user; and a weak pressure release arm having a distal end that is configured to contact and engage with the frame to move the pressure arm against the urging force of the spring, thereby producing a weak pressing state in which the urging force applied to the pressure roller by the spring is decreased.

19. The image forming device according to claim 18, further comprising:

a main casing configured to accommodate the image forming unit and the fixing device; and a cover that is disposed on the main casing so as to open and close, wherein the operating part of the pressing force adjusting member is accommodated within the main casing without extending outside the main casing when the distal end of the pressing force adjusting member is in engagement with the frame to produce the weak pressing state.

20. The image forming device according to claim 18, further comprising:

a main casing configured to accommodate the image forming unit and the fixing device, and;

a cover that is disposed on the main casing so as to open and close, wherein:

the fixing device further includes a pressure releasing member separate from the pressing force adjusting member and pivotably supported on the pressure arm at a position separated from the pivoting center of the pressure arm, the pressure releasing member including a lever that is configured to be operated by a user and a release arm having a distal end that is configured to contact and engage with the frame, thereby separating the pressure roller from the heating roller against the urging force of the spring;

the pressure releasing member is configured to pivot between a pressing position and a release position so as to move the pressure roller between a first position at which the pressure roller is in pressing contact with the heating roller due to the urging force of the spring and a second position at which the pressure roller is separated from the heating roller against the urging force of the spring;

the lever of the pressure releasing member protrudes outside the main casing when in the release position and is accommodated in the main casing without protruding outside the main casing when in the pressing position; and the cover presses the lever of the pressure releasing member in the release position when the cover is closed, thereby returning the pressure releasing member from the release position to the pressing position.

* * * * *